US011033948B2

(12) United States Patent
Morgan et al.

(10) Patent No.: US 11,033,948 B2
(45) Date of Patent: Jun. 15, 2021

(54) FORMING MULTI-TOOL

(71) Applicant: MATE PRECISION TOOLING, INC., Anoka, MN (US)

(72) Inventors: Christopher Morgan, Minneapolis, MN (US); Bruce Thielges, Fridley, MN (US)

(73) Assignee: Mate Precision Technologies Inc., Anoka, MN (US)

( * ) Notice: Subject to any disclaimer, the term of this patent is extended or adjusted under 35 U.S.C. 154(b) by 50 days.

(21) Appl. No.: 16/427,230

(22) Filed: May 30, 2019

(65) Prior Publication Data

US 2019/0366411 A1 Dec. 5, 2019

Related U.S. Application Data

(60) Provisional application No. 62/678,029, filed on May 30, 2018.

(51) Int. Cl.

| | |
|---|---|
| ***B21D 28/12*** | (2006.01) |
| ***B21D 28/14*** | (2006.01) |
| *B21D 28/32* | (2006.01) |

(52) U.S. Cl.

CPC ..... *B21D 28/125* (2013.01); *B21D 28/12* (2013.01); *B21D 28/14* (2013.01); *B21D 28/325* (2013.01)

(58) Field of Classification Search

CPC ..... B21D 28/125; B21D 28/14; B21D 28/12; B21D 28/325

USPC ..... 83/552

See application file for complete search history.

(56) References Cited

U.S. PATENT DOCUMENTS

| | | | | |
|---|---|---|---|---|
| 2,671,354 | A | 3/1954 | Enrique | |
| 2,820,936 | A * | 1/1958 | Rainey | B30B 15/047 318/600 |
| 5,901,628 | A * | 5/1999 | Sakamoto | B21D 28/12 83/552 |
| 6,565,349 | B1 * | 5/2003 | Tanaka | B21D 28/14 264/157 |
| 8,511,128 | B2 * | 8/2013 | Boepple | B23K 26/38 72/328 |
| 10,507,508 | B2 * | 12/2019 | Kimura | B21D 28/12 |
| 2002/0162440 | A1 * | 11/2002 | Ostini | B21D 37/04 83/552 |
| 2002/0194972 | A1 * | 12/2002 | Ozeki | B21D 28/12 83/552 |

(Continued)

FOREIGN PATENT DOCUMENTS

| | | |
|---|---|---|
| GB | 134371 | 11/1919 |
| JP | 2011143469 A | 7/2011 |

OTHER PUBLICATIONS

International Search Authority, "International Search Report and Written Opinion for PCT Application No. PCT/US2019/034743", "Foreign Counterpart to U.S. Appl. No. 16/427,230", dated Sep. 16, 2019, pp. 1-14, Published in: WO.

*Primary Examiner* — Sean M Michalski

(74) *Attorney, Agent, or Firm* — Dorsey & Whitney LLP

(57) ABSTRACT

A punch and die set and selection apparatus adapted for sheet material forming, to work cooperatively with an automated punch press to select one of a set of punches and dies to operate within said apparatus to be engaged with the punch-press load-applying ram and tool holders, and to compel or allow the non-selected dies to be moved away from the sheet material so as not to impinge on or damage the sheet material being formed.

19 Claims, 32 Drawing Sheets

(56) References Cited

U.S. PATENT DOCUMENTS

| | | | | |
|---|---|---|---|---|
| 2004/0154453 | A1* | 8/2004 | Kobayashi | B21D 28/125 83/691 |
| 2007/0101798 | A1* | 5/2007 | Sakamoto | B21D 28/12 72/442 |
| 2011/0107888 | A1* | 5/2011 | Thielges | B21D 28/125 83/139 |
| 2015/0020663 | A1* | 1/2015 | Windingstad | B21D 45/003 83/136 |
| 2015/0158072 | A1* | 6/2015 | Komiya | B21D 28/14 83/23 |
| 2015/0239084 | A1* | 8/2015 | Rose | B21D 28/36 483/1 |

* cited by examiner

FORMING MULTI-TOOL

TECHNICAL FIELD

This application is directed to assemblies for punch forming operations, and related machine tool and die systems and methods. Applications include, but are not limited to, multi-tool and multi-die carrier assemblies configured for selective actuation of individual tools and dies, respectively.

BACKGROUND

In the fabrication of sheet metal and other workpieces, automated machinery may be employed, including turret presses and other industrial presses. Turret presses typically have an upper turret that holds a series of punches at locations spaced circumferentially about its periphery, and a lower turret that holds a series of dies at locations spaced circumferentially about its periphery. The press can be rotated about a vertical axis to bring a desired punch and die set into vertical alignment at a work station. By appropriately rotating the upper and lower turrets, an operator can bring a number of different punch and die sets sequentially into alignment at the work station in the process of performing a series of different pressing operations. Turret press multi-tools thus expand press operations by providing a variety of tools in a single assembly, analogous to a turret within a turret.

Multi-tools for turret presses advantageously allow a plurality of different tools to be available at a single tool-mount location on the press. Thus, in place of a tool with only one punch, there can be provided a multi-tool carrying a number of different punches. With such a multi-tool, any one of a plurality of punches carried by the multi-tool can be selected and moved to an operable position. When a multi-tool punch assembly is struck from above by the punch press ram, a single, selected punch element or punch insert within the assembly is driven downwardly through the workpiece to perform the punching operation, while the other punches (those not selected) remain inactive. When released, the punch insert is retracted by a spring or similar component provided in the multi-tool punch assembly. Different multi-tool designs employ different mechanisms in the punch press and the multi-tool to select one pair of complementary tools for a given operation, while the other tools remain inactive. Most preexisting mechanisms simply do not connect the unselected punches with movement of the press ram.

Piercing in a multi-tool is very common, but preexisting multi-tool assemblies often lack multiple forming dies due to concerns that additional forming dies could interfere with a workpiece due to the close proximity of the dies and protrusion of each die up toward the workpiece. Accordingly, adding multiple forming dies, e.g., positioned below a workpiece, would be desirable. Adding forming tools, e.g., punches, to preexisting multi-tool assemblies in a manner that better facilitates interchangeability between individual tools would also be desirable. Selecting individual tools via a locking or latching mechanism, for example similar to the locking mechanism described in U.S. Pat. No. 2,671,354 (Enrique), which is incorporated by reference in its entirety herein, would also be desirable for improved ease of use.

SUMMARY

Multi-tool assemblies include multiple forming dies and multiple punches. A multi-die assembly is configured to provide automated displacement of individual forming dies by selectively elevating and/or supporting each die, one at a time, to a useful height for forming operations, while the other, unselected dies are lowered or retracted, thereby protecting the workpiece from unwanted damage. When no die from the multi-tool is needed for a punching operation, the multi-tool could be such that all dies are in the down inactive position to avoid any unnecessary sheet marking.

DETAILED DESCRIPTION

Figure 1:
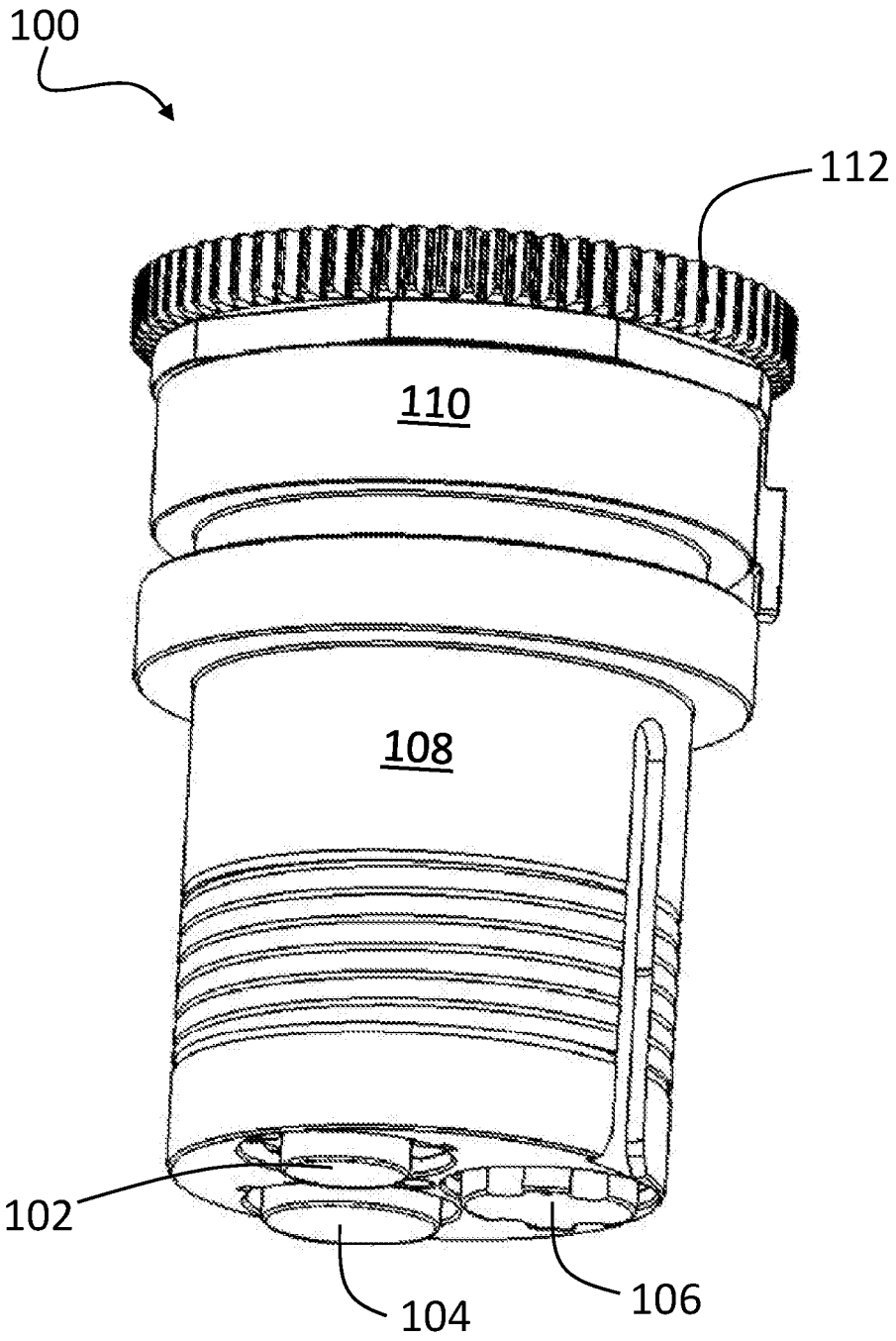
FIG. 1 is as isometric view of a multi-tool punch assembly in accordance with principles of the present disclosure.

FIG. 1 is an isometric view of a multi-tool assembly 100, which may also be referred to as a forming punch tool assembly or upper assembly. As shown, multi-tool assembly 100 includes three punch stations 102, 104, 106 coupled with a punch guide body 108. Each punch station can include a uniquely sized and/or shaped forming punch tool. The punch guide body 108 is attached to a punch carrier 110 and an upper portion or cap 112 of a striker body. The striker body may be generally cylindrical in shape, with a wider diameter defining the cap 112, which in some examples forms the top face of multi-tool assembly 100. A narrower portion of the striker body may be inserted within punch carrier 110, as shown for example in FIG. 3. The specific forming tool to be employed for a particular operation can be selected by positioning an internal ram over the selected tool, thereby positioning the tool to be engaged by the press striker ram. The multi-tool 100 shown in FIG. 1 includes three forming punch tools ("punches" or "tools"); additional embodiments may include two, three, four, five, six, seven or more tools.

Figure 2:
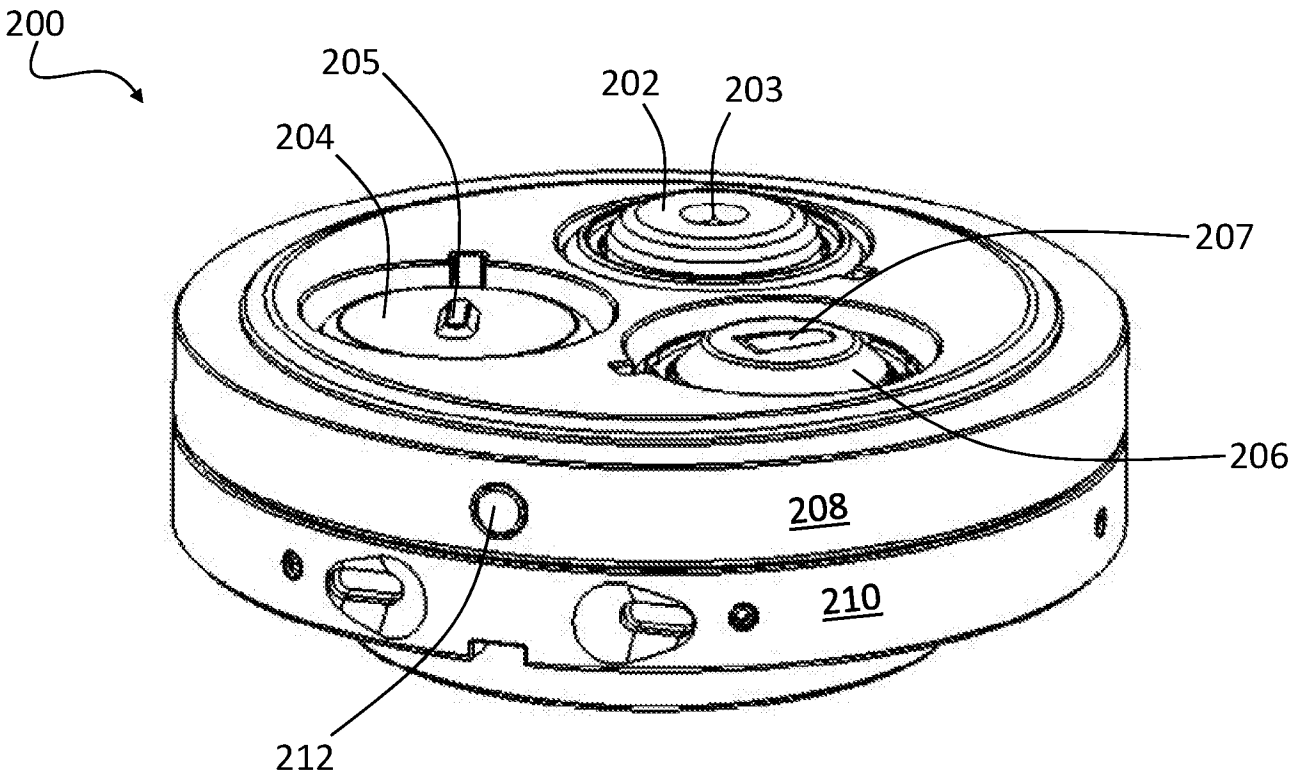
FIG. 2 is an isometric view of a multi-die carrier assembly containing three dies in accordance with principles of the present disclosure.

FIG. 2 is an isometric view of a multi-die carrier assembly 200 which includes three work stations containing forming dies 202, 204, 206, respectively. As shown, the body of the multi-die carrier assembly 200 may define a generally circular perimeter, although the shape may change in different embodiments. The work stations of multi-die carrier assembly 200 may be complementary to the punch stations included in multi-tool assembly 100, such that punch stations 102, 104, 106 can be aligned with, and engage, forming dies 202, 204 and 206, respectively, during a forming operation. Forming die 202 defines a central forming portion 203, forming die 204 defines a protruding forming portion 205, and forming die 206 defines a tab forming portion 207. Multi-die carrier assembly 200 is comprised of a die locator component 208 and a cam base 210, which may be referred to as upper and lower components, respectively, depending on orientation. A slidable lock pin 212 is visible at a sidewall of die locator component 208. In operation, movement of lock pin 212 causes locking and unlocking of die locator component 208 with respect to cam base 210. When unlocked, cam base 210 can be rotated relative to die locator component 208. Accordingly, in this embodiment, die locator component 208 can remain stationary, while came base 210 can be configured to rotate. In additional examples, die locator component 208 may be configured to rotate, while cam base 210 remains stationary. In some examples, one or more of the stationary components included within a given assembly may be referred to as a stator component.

An internal cam ramp defined by cam base 210, upon rotation thereof, selectively elevates individual forming dies, one-by-one, into a position for forming a workpiece. The multi-die carrier assembly 200 shown in FIG. 2 includes a single lock pin 212; additional embodiments may include, e.g., one, two, three or more lock pins. In addition or alternatively, one or more cams or levers can be included to actuate the engagement of die locator component 208 and/or cam base 210. The multi-die carrier assembly 200 shown in FIG. 2 includes three forming dies, but additional embodiments may include 2, 4, 5, 6, 7 or more dies. Together, assemblies 100 and 200 may comprise a punch and die set and selection apparatus, which may be configured to work cooperatively with an automated punch press in some examples to select one of a set of punches and dies to operate within the apparatus to be engaged with a load-applying ram and tool holders, and to compel or allow the non-selected die or dies to be moved away from a sheet material or workpiece.

Figure 3:
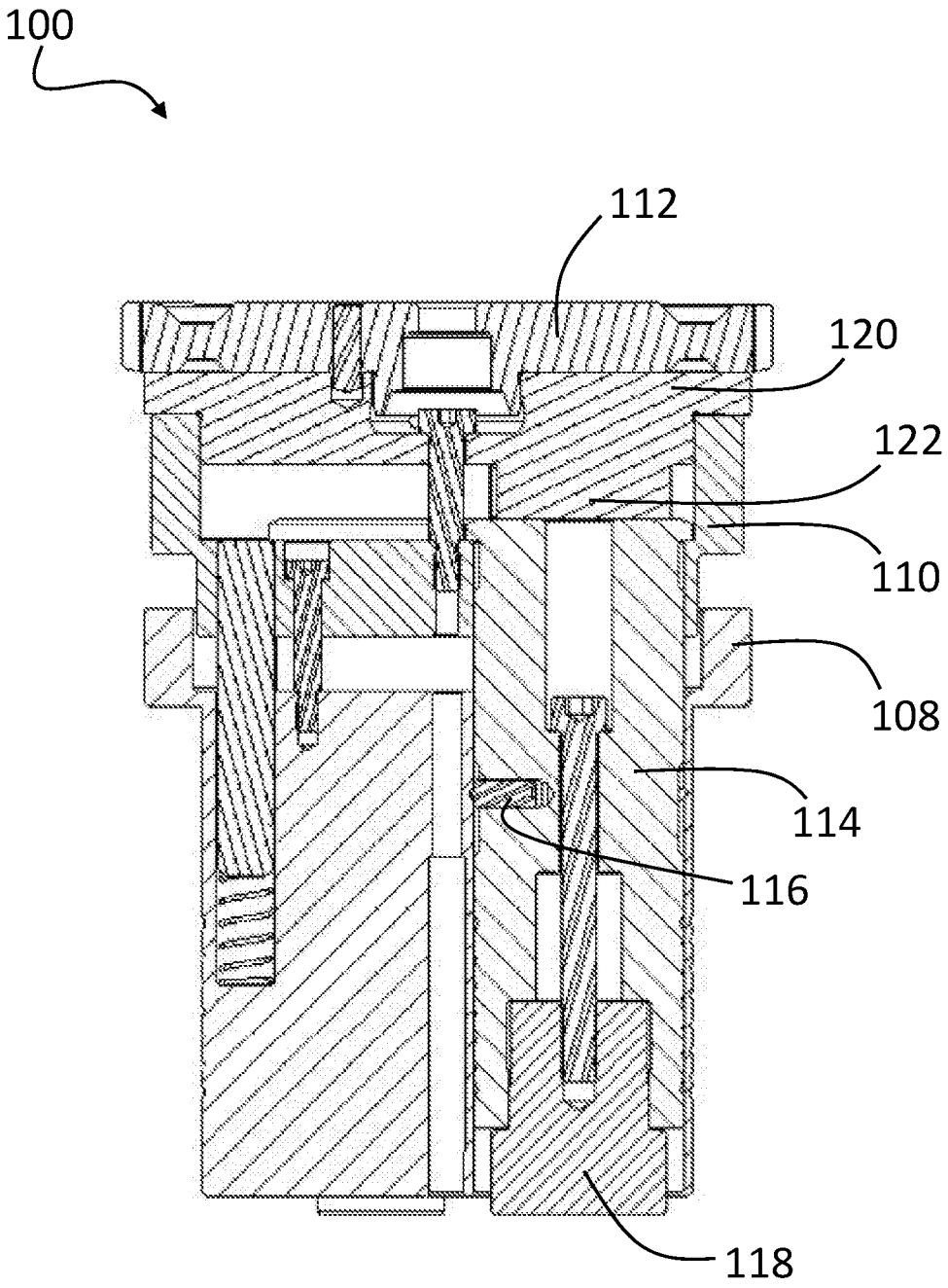
FIG. 3 is a section view of a multi-tool punch assembly in a relaxed configuration.

FIG. 3 is a section view of multi-tool assembly 100 in a relaxed configuration, in which none of the forming punch tools have been lowered into a punching configuration. Within punch guide body 108, a punch driver 114 is included, along with a ball plunger 116. A forming punch tool 118 is shown in a first, inactive position. In this position, forming punch tool 118 is not lowered into a position for operating on a workpiece. Within punch carrier 110, striker body 120 is also shown, which defines a striker ram 122, both components positioned below striker cap 112. In total, multi-tool assembly 100 may include three punch drivers, one for each work station, but the number of punch drivers and work stations may vary, ranging from one to 10 or more in various embodiments. The remainder of the forming punch drivers (the "inactive" punch drivers) are not shown in this cross-section. Each forming punch driver 114 may be identical in structure, and can be designed to be fitted with differing punches. When the press apparatus within which multi-tool assembly 100 is mounted strokes the selected punch downward pursuant to a workpiece forming operation, the non-selected forming punch tools can remain in the upward, inactive position within the assembly. Selection of each individual forming punch tool can be achieved by rotating striker ram 122, which may be effected via a gear drive, shot pin, external rotating ram, auto-index mechanism, or similar means, for example as described in U.S. Pat. No. 8,413,561 (Thielges et al.) and/or U.S. Patent Pub. No. 2004/0169069 A1 (Ostini), each of which are incorporated by reference herein, in their entirety. The specific forming punch tool and angle of the tool relative to a workpiece can each be adjusted in some examples. Multi-tool assembly 100 also has a reduced stripping force, or punch-lifting force, relative to preexisting multi-tool assemblies, allowing smaller lift springs to be included in the assembly. Multi-tool assembly 100 also has extra clearance at the punch tip area relative to preexisting designs, rendering it especially suitable for forming operations.

Figure 4:
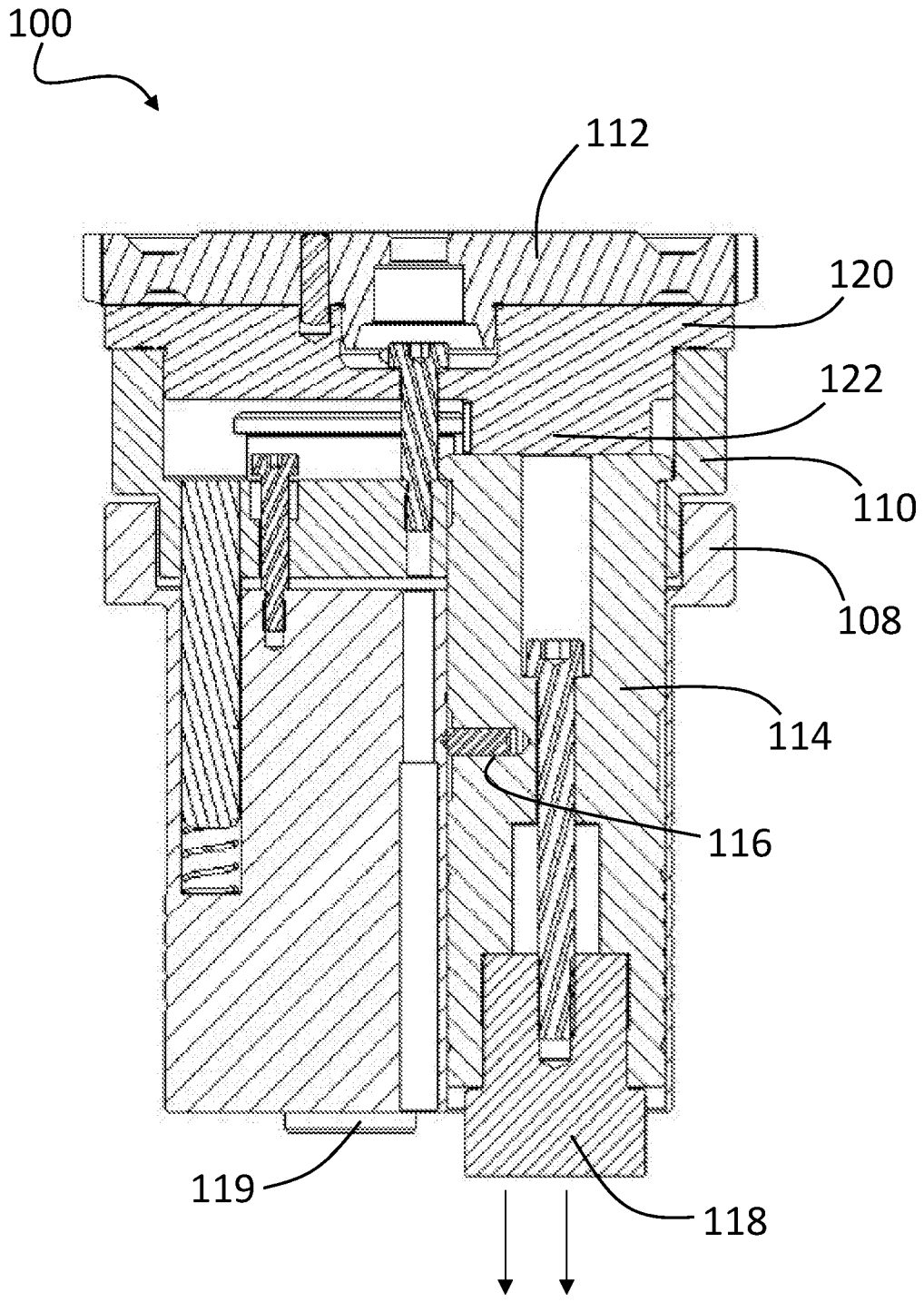
FIG. 4 is a section view of the multi-tool punch assembly of FIG. 3 in an active configuration.

FIG. 4 is a section view of multi-tool assembly 100 in an active configuration. As shown, forming punch tool 118 has been moved downward, away from guide body 108 in the direction of the arrows, positioning the tool for operation on a workpiece. By contrast, forming punch tool 119 remains in the inactive position, closer to guide body 108. Movement of forming punch tool 118 can be effected via selective rotation of striker body 120, such that striker ram 122 contacts punch driver 114 and pushes it toward punch tool 118. As noted on the figure, there may be no gap between striker ram 122 and punch driver 114. In some examples, a gear mechanism forces striker cap 112 downward during a punching operation. To return forming punch tool 118 to its inactive position, striker body 120 can be rotated again, for example such that striker ram 122 is positioned above punch tool 119, thereby causing punch tool 119 to extend away from guide body 108 and into its operational position. Punch driver 114 may comprise a unitary, one-piece body. In another embodiment, the upper assembly, holding the set of forming punches, could utilize a multi-tool suitable for a punching sheet material, or a similar design; e.g., where the upper assembly is adapted for holding a set of forming punches matched to a die set of a die carrier assembly.

Figure 5:
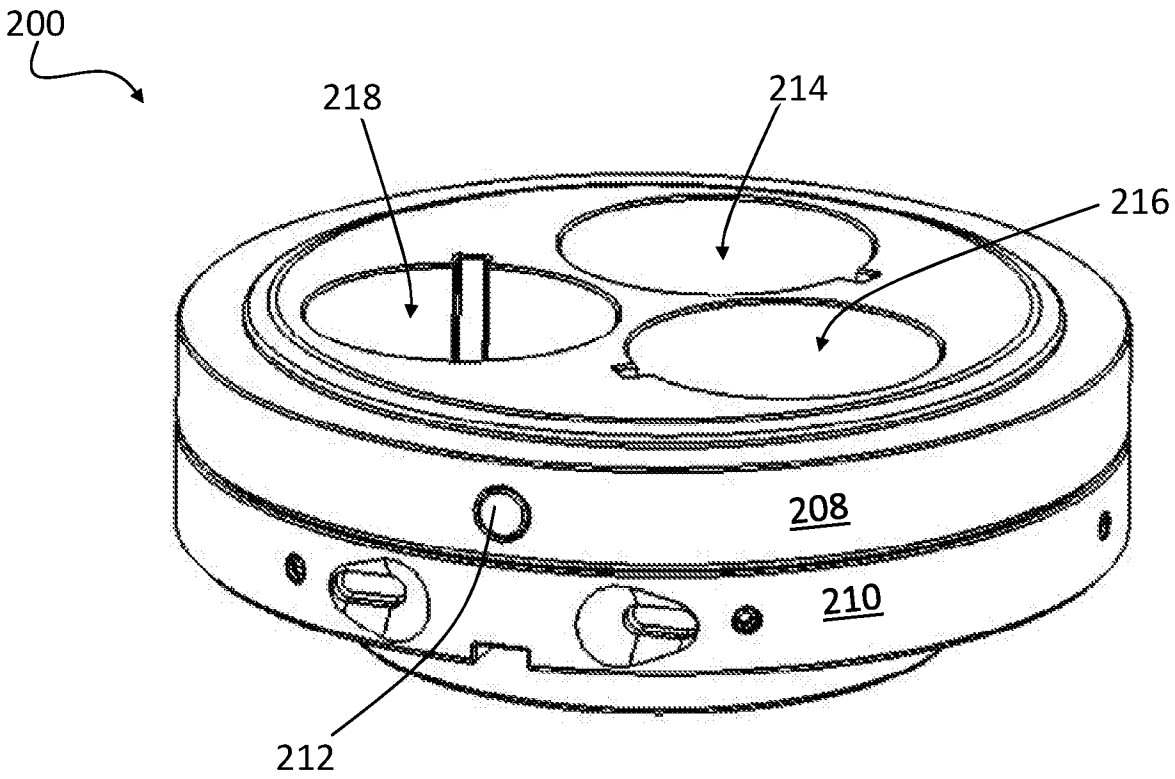
FIG. 5 is an isometric view of the multi-die carrier assembly of FIG. 2 containing no dies.

FIG. 5 is an isometric view of multi-die carrier assembly 200 containing no dies. Without the dies installed, the die bores 214, 216, 218 configured to receive the dies are plainly visible. The die bores 214, 216, 218 shown in this example are cylindrical, but the shape may vary in other embodiments as necessary to accommodate differently shaped dies.

Figure 6:
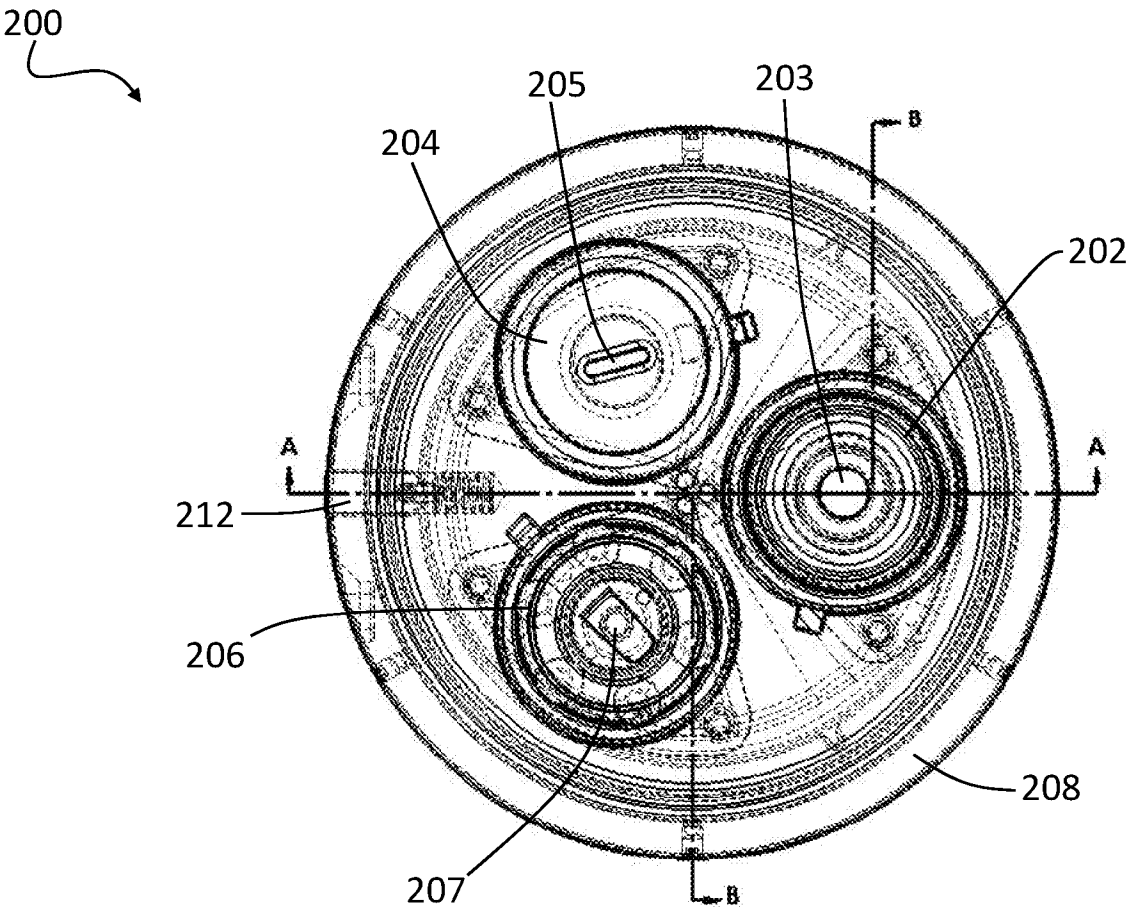
FIG. 6 is a plan view of the multi-die carrier assembly of FIG. 2.

FIG. 6 is a plan view of multi-die carrier assembly 200, showing a top surface of all three forming dies 202, 204, 206 installed. Preexisting multi-tool assemblies typically do not employ multiple forming dies because the non-selected dies would interfere with the workpiece or induce undesired forms on the material.

Figure 7:
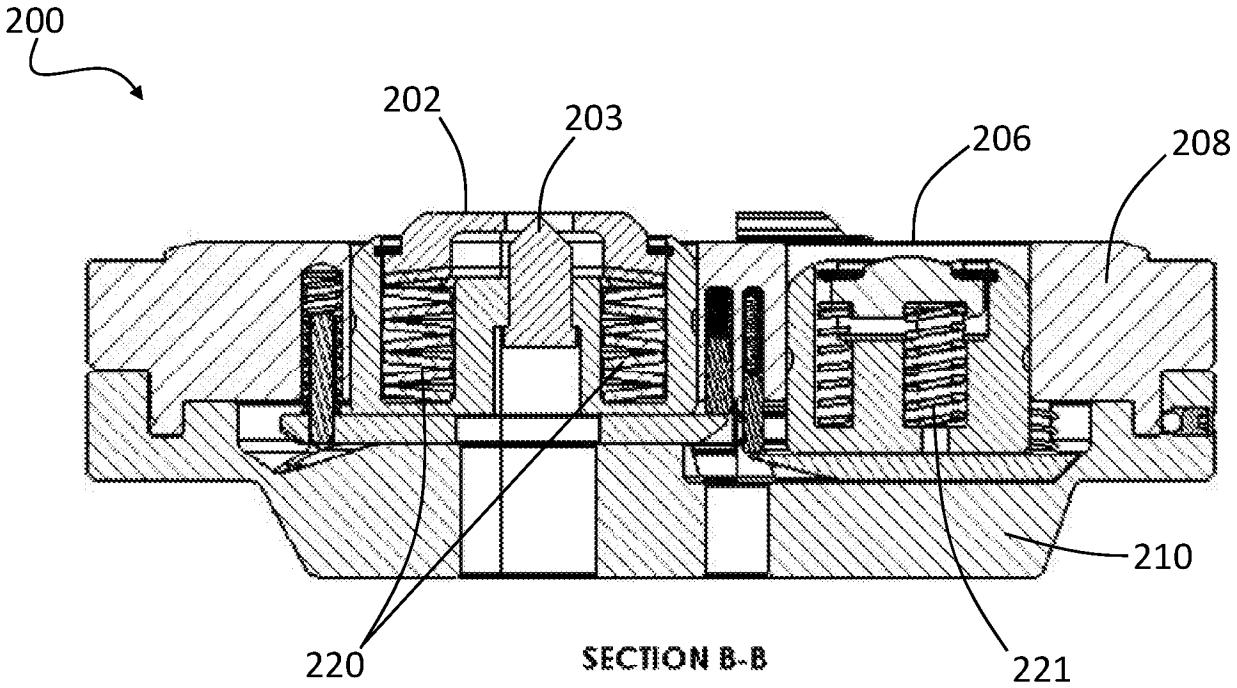
FIG. 7 is a section view of the multi-die carrier assembly taken along line B-B of FIG. 6.

FIG. 7 is a section view of multi-die carrier assembly 200 taken along line B-B of FIG. 6, such that cam base 210 is shown positioned below die locator component 208. Die 202 is shown including an internal, circumferential bias member or spring 220; e.g., a Belleville spring or similar bias component configured to reduce the stripping force within each die, and forming portion 203. A portion of forming die 206 is also shown, including internal bias member or spring 221, which may also reduce a stripping force of the die.

Figure 8:
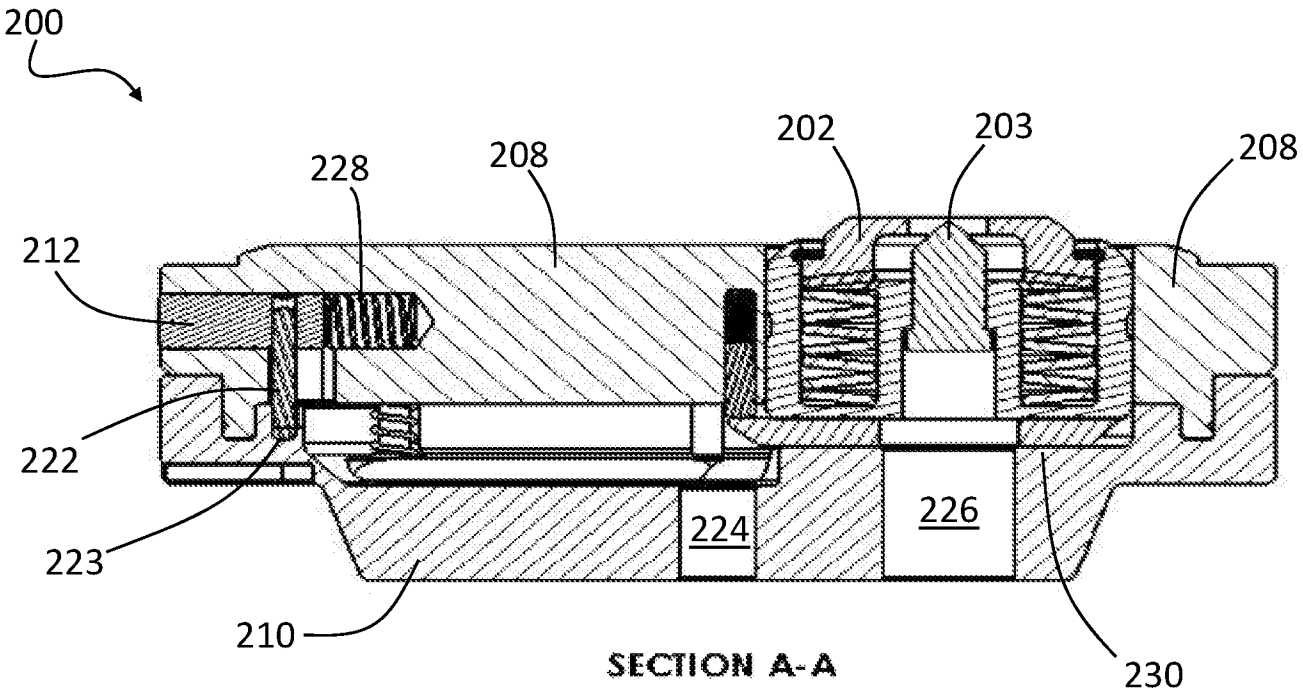
FIG. 8 is a section view of the multi-die carrier assembly taken along line A-A of FIG. 6.

FIG. 8 is another section view of multi-die carrier assembly 200, showing forming die 202 and lock pin 212, which is coupled with vertical pin 222. Because lock pin 212 is coupled with vertical pin 222, lateral movement of lock pin 212 also causes lateral movement of vertical pin 222. In the locked configuration shown in FIG. 8, vertical pin 222 is resting within a complementary groove or key slot 223 defined by cam base 210, thereby securing die locator component 208 to cam base 210. Sliding lock pin 212 into the body of die locator component 208 compresses an internal spring 228. Release of lock pin 212 allows spring 228 to expand back to its resting state, moving in an outward direction with respect to die locator component 208. In this manner, lock pin 212 may be biased toward the locked position, such that cam base 210 is not allowed to rotate freely without actuation, which may be driven by a press apparatus or component thereof in some examples.

As further shown, cam base 210 can define one or more bores, such as central bore 224 and lower through-bore 226. Central bore 224, which can be optional, can be configured to collect debris, such as metal shards, that are often created during punching operations. Lower through-bore 226 can receive a die extension or protrusion, which may be defined by some die members, such as die members configured to move downward, within the bore, in response to a downward force applied by a complementary punch tool. The lower through-bore 226 can also allow the ejection of sheet material, as might occur in combination with pierce-and-form tool sets. As further shown, cam base 210 may define an internal cam ramp 230 configured to elevate and/or support individual dies, such as die 202 in the configuration shown.

Figure 9:
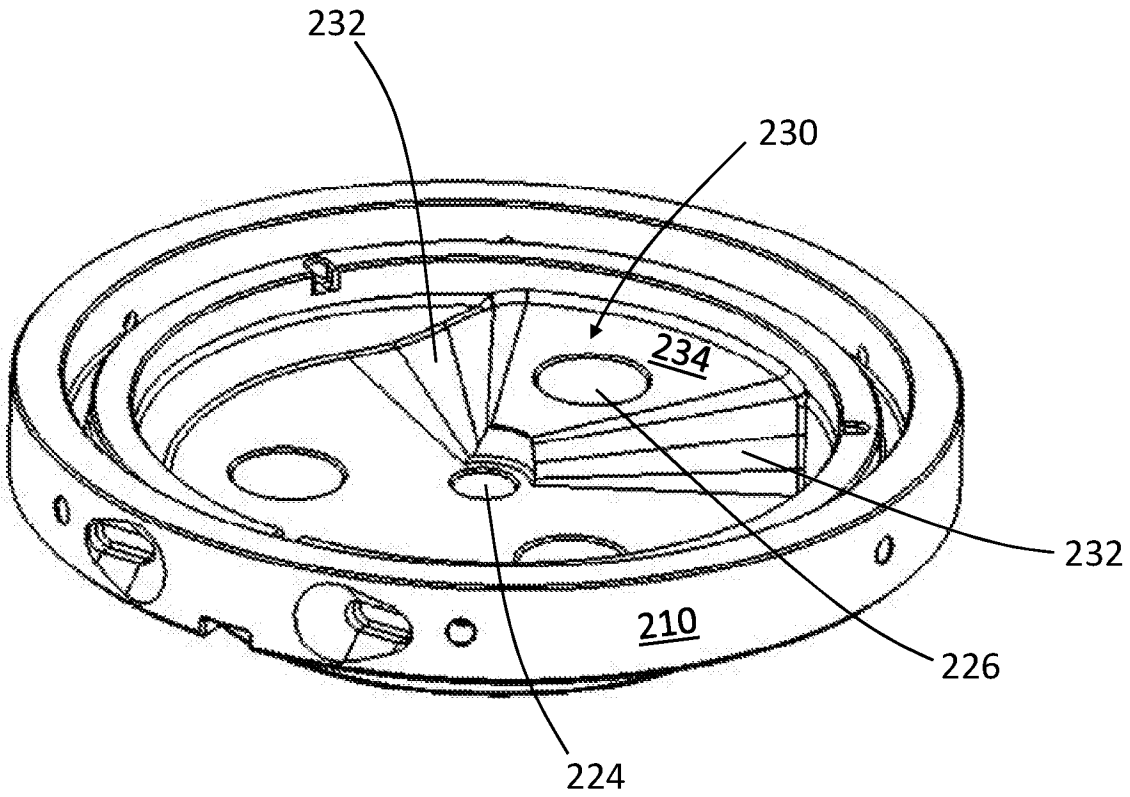
FIG. 9 is an isometric view of a cam base.

FIG. 9 is an isometric view of cam base 210 showing cam ramp 230, which resembles a plateau shape comprised of two opposing ramped surfaces 232 flanking a central flat portion 234 in this example. The cam ramp 230 rotates with rotation of the cam base 210, providing the structure necessary to elevate an individual die from below while the remaining dies not positioned above cam ramp 230 are allowed to remain in or drop down to a lowered position, away from the workpiece, such that the lowered dies do not interfere with a punching operation until selectively raised by cam ramp 230. Cam ramp 230 can be rotated by an indexing mechanism of a CNC punch press, for example, while a shot pin or other holding member holds die locator component 208 stationary, such that die locator component 208 captures the dies in their radial, or x-y position, while cam ramp 230 operates to displace and/or support one of the dies vertically, raising it to or holding it at a useful position for sheet material forming. In other embodiments, the cam base 210 can remain stationary, thus serving as the stator component in the assembly, and the die locator component 208 can be rotatable, such as depicted in FIGS. 19A-D. Cam ramp 230 can support one die rigidly while the other die or dies are allowed to lower if impinged on sufficiently to overcome a resilient, frictional, or elastic means holding or biasing the non-selected dies in an upper position. Accordingly, the selected die is supported by cam ramp 230 so as to be secured sufficiently for material forming, while the other die or dies are only resiliently or frictionally supported. Other rotatable or stationary selectors can be utilized in embodiments described herein.

Figure 10:
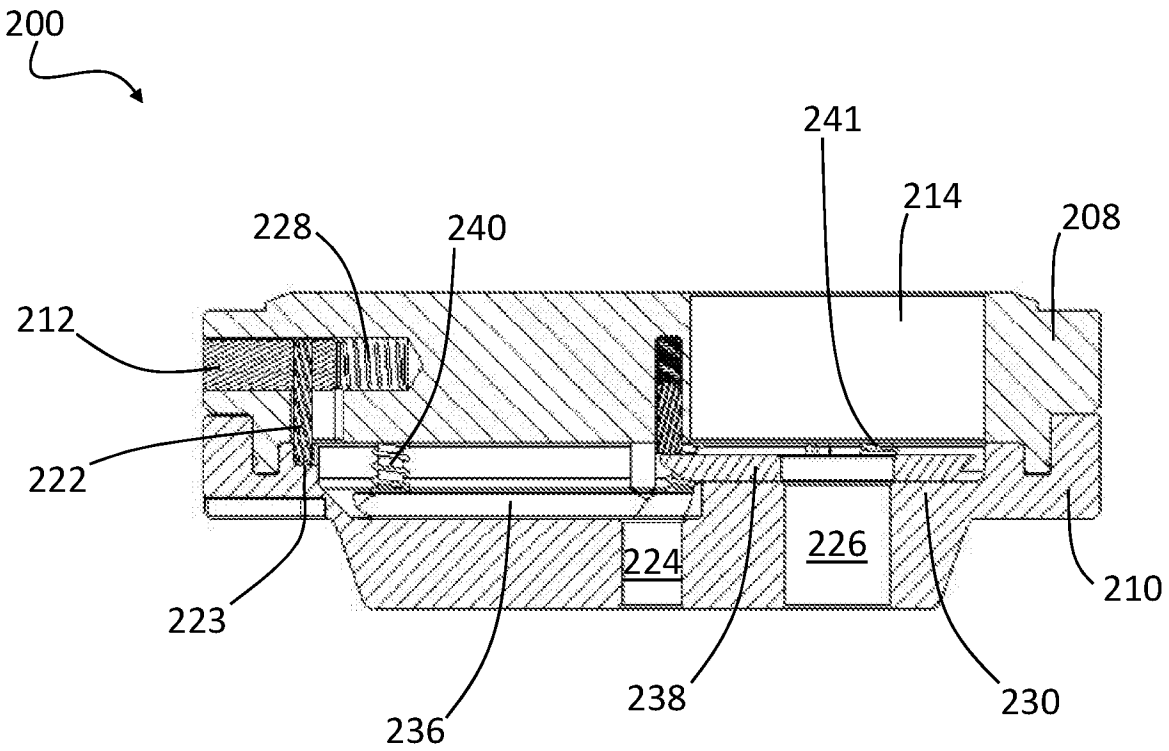
FIG. 10 is a section view of a multi-die carrier assembly in a locked configuration.

FIG. 10 is another section view of multi-die carrier assembly 200 in the locked configuration. As shown, lock pin 212 has not been slid laterally inward, such that spring 228 remains uncompressed. Consequently, vertical pin 222 remains engaged with key slot 223 defined by cam base 210, thereby locking cam base 210 to the upper die locator component 208 and preventing rotation of the cam base relative to the die locator component. Lock pin 212 can be actuated by a pin member, e.g., a shot pin, of a press apparatus to release the internal locking mechanisms of assembly 200, which effects holding of the upper part, so as to become a die locator, while the press can use an auto-index mechanism, or similar means to rotate the lower cam base. Central bore 224 and lower through-bore 226 are also visible. Above each bore, sandwiched between cam base 210 and die locator component 208 lies two die shoes 236, 238. Die shoes 236, 238 may be optionally included, and as shown in FIG. 10, may define elongate, flat disc-like components positioned underneath each die. Vertical springs 240, 241 may be configured to exert a downward biasing force on the die shoes, holding them in place during working operations and movement of cam ramp 230, such that each die shoe may remain below the same die regardless of cam base configuration. Thus, in various embodiments, cam ramp 230 may operate directly on the dies, or on die shoes positioned between the dies and the cam ramp. Die bore 214 is also shown formed into die locator component 208. Die bore 214 is configured to receive and hold various forming dies, some of which may include a downward extension or protrusion, which may extend into lower die bore 226. In some examples, a die sleeve can be included to operate as an intermediate component between a die and a die locating cassette. Various combinations of die shoe and die sleeve are possible.

Figure 11:
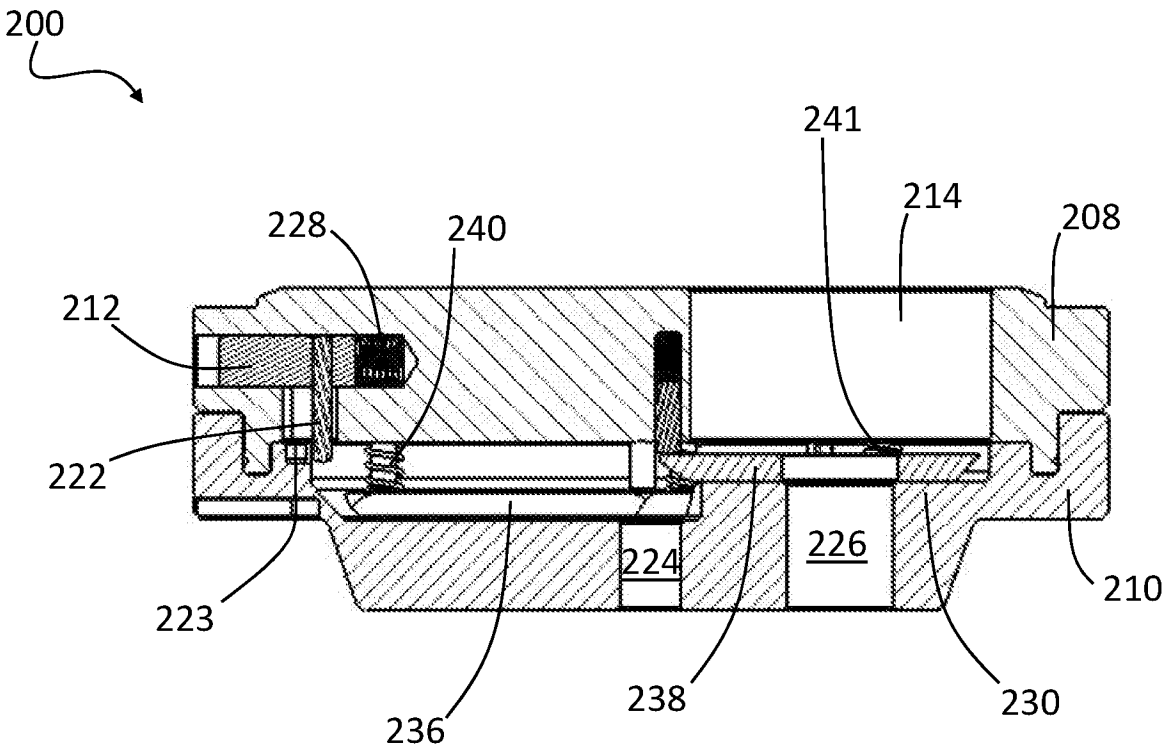
FIG. 11 is a section view of a multi-die carrier assembly in an unlocked configuration.

FIG. 11 is a section view of multi-die carrier assembly 200 in an unlocked configuration. Lock pin 212 has been slid laterally inward, along with vertical pin 222, thereby compressing spring 228 and vacating key slot 223. Movement of vertical pin 222 out of key slot 223 disengages die locator component 208 from cam base 210, such that cam base 210 may be rotated relative to the die locator component 208, which may remain stationary. As cam base 210 rotates, cam ramp 230 defined by the cam base also rotates until positioned beneath a die desired for a specific operation. Key slot 223 can be keyed into a turret press upon which carrier assembly 200 is mounted. The turret press can thus activate rotation of cam base 210 via engagement with key slot 223.

Figure 12:
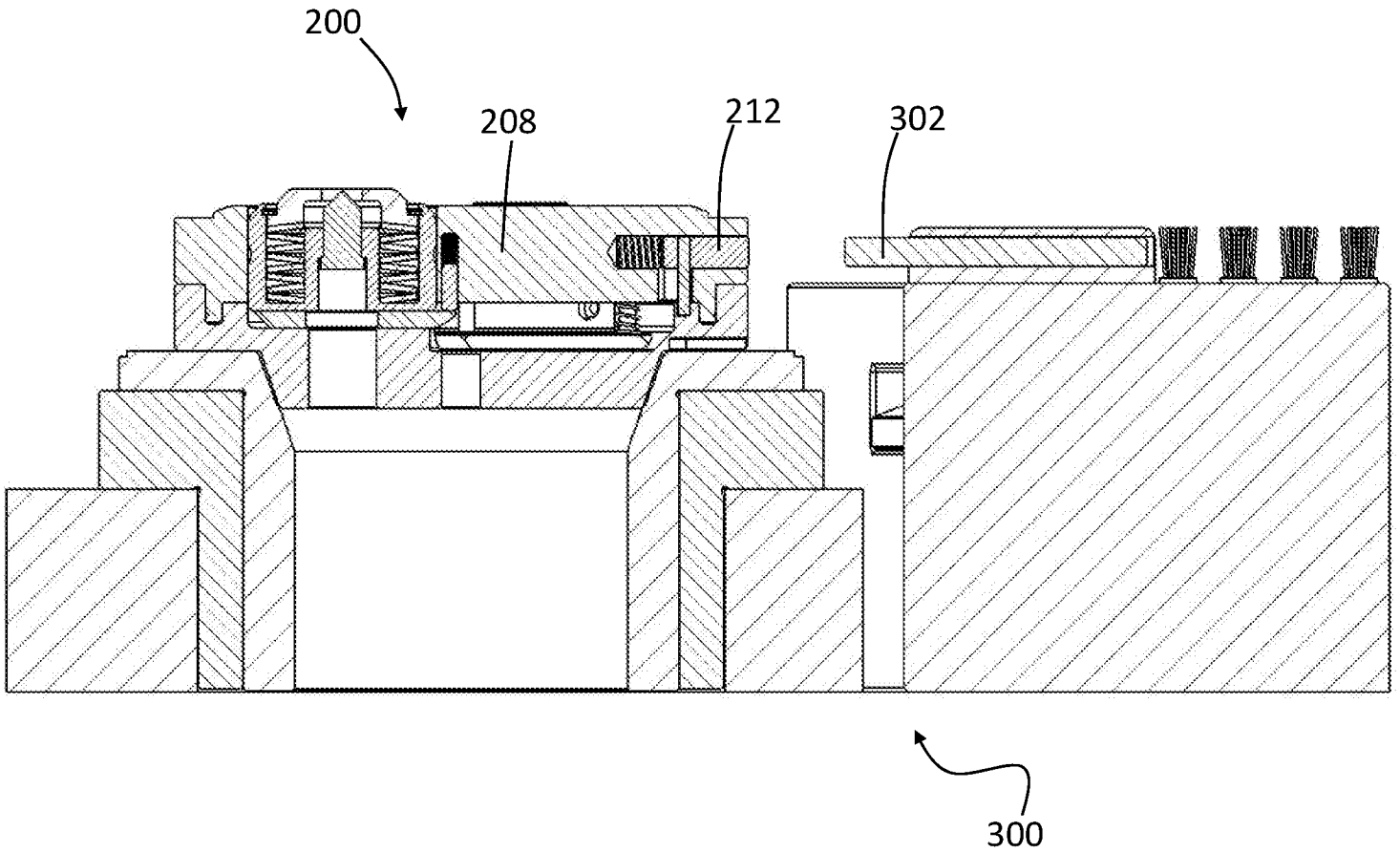
FIG. 12 is a section view of a multi-die carrier assembly mounted in a press apparatus in a locked configuration.

FIG. 12 is a section view of multi-die carrier assembly 200 mounted on a press apparatus 300, e.g., turret press, in a locked configuration. As shown, press apparatus 300 may comprise a shot pin 302, which is aligned with lock pin 212. Shot pin 302 can be configured to slide laterally toward and away from lock pin 212. At the snapshot depicted, shot pin 302 is positioned in a retracted position, laterally separated from an outer end of lock pin 212.

Figure 13:
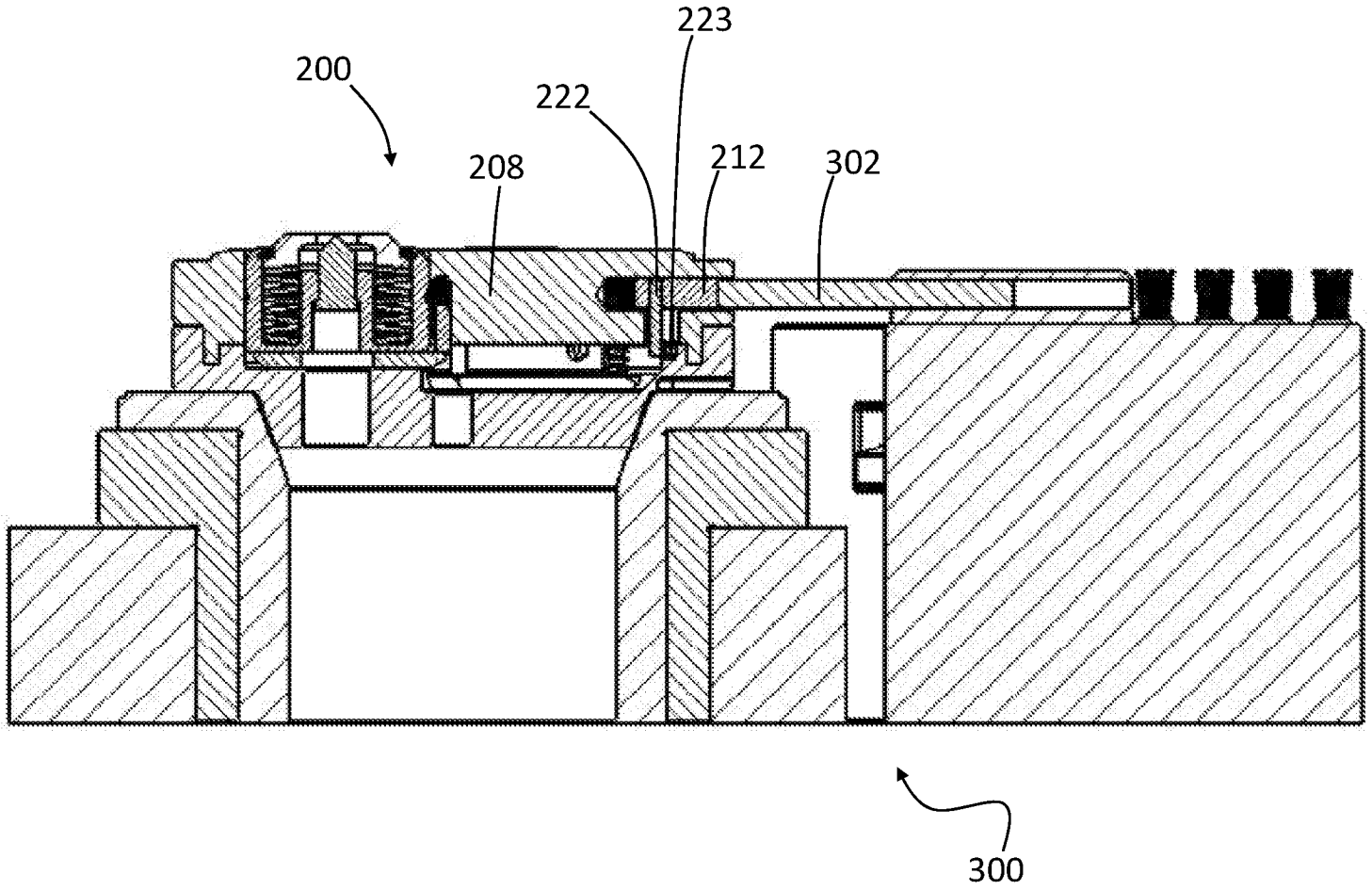
FIG. 13 is a section view of the multi-die carrier assembly in the press apparatus of FIG. 12 in an unlocked configuration.

FIG. 13 is a section view of multi-die carrier assembly 200 and press apparatus 300 in an unlocked configuration. Shot pin 302 has been extended laterally by the press, such that it contacts and pushes lock pin 212 inward within the body of die locator component 208. Movement of lock pin 212 in response to movement of shot pin 302 causes lateral displacement of vertical pin 222 out of key slot 223, thus allowing cam base 210 to be rotated under the control of the press (and the operator of the press). Accordingly, multi-die carrier assembly 200 can be manipulable by automated press actuation to raise one selected die up to a useful working position, e.g., at or near a workpiece, while the other die or dies included in the assembly may remain substantially lower and away from the workpiece.

Figure 14:
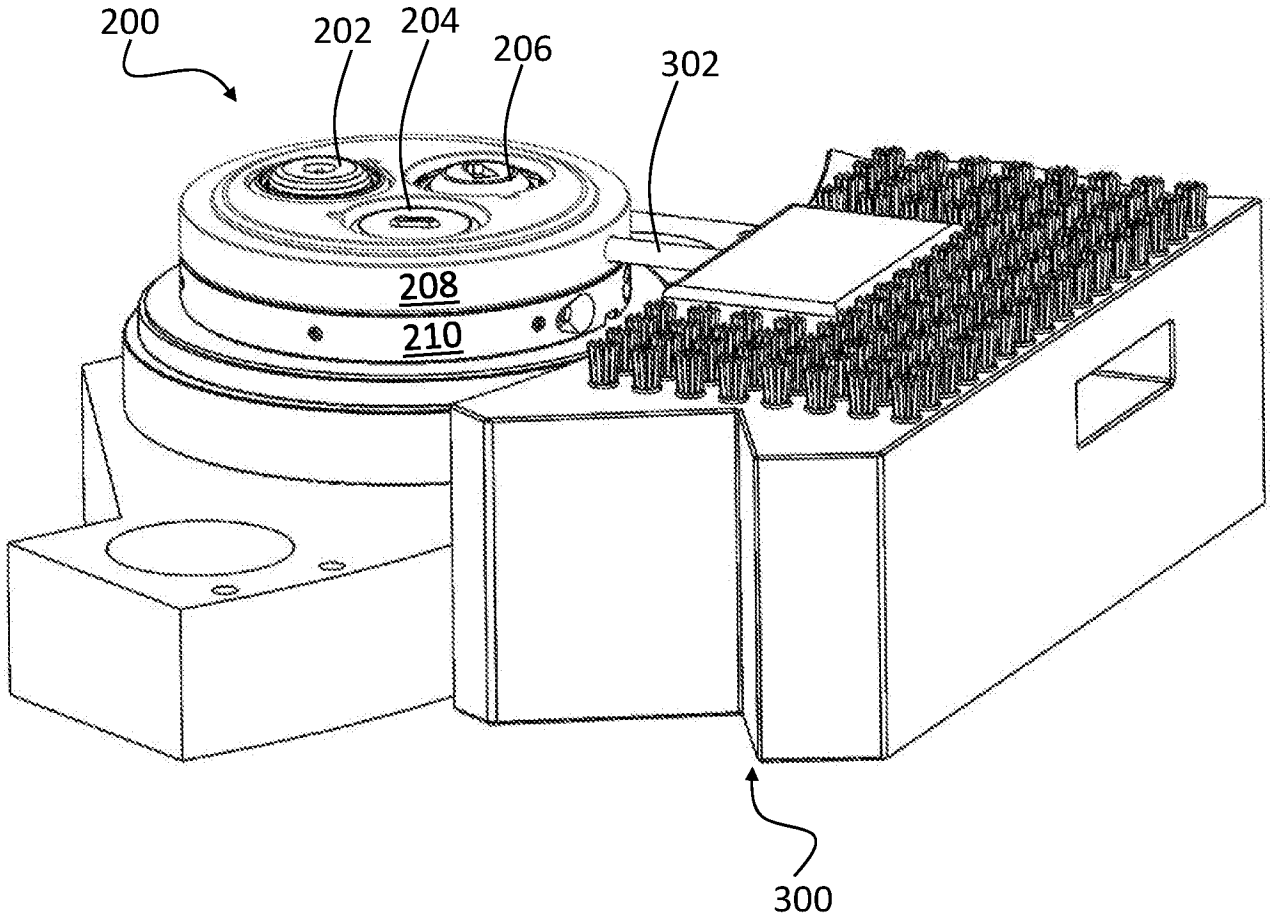
FIG. 14 is an isometric view of the multi-die carrier assembly and press apparatus shown in FIGS. 12 and 13 before rotation of the multi-die carrier base.

FIG. 14 is an isometric view of multi-die carrier assembly 200 and press apparatus 300. In the configuration shown, shot pin 302 has been extended within assembly 200, where an outer end of the shot pin contacts lock pin 212. In this configuration, forming die 202 is elevated by the internal cam ramp defined by cam base 210. The cam or die displacement element can also facilitate a configuration with some of the dies down, or otherwise held in place, for example with a selected die of the set of installed set of dies being raised for forming use. All of the dies could also be deselected, or in the down or fixed position, for example to prevent damage to the workpiece from a raised die, when punching or forming with an adjacent or nearby turret station.

Figure 15:
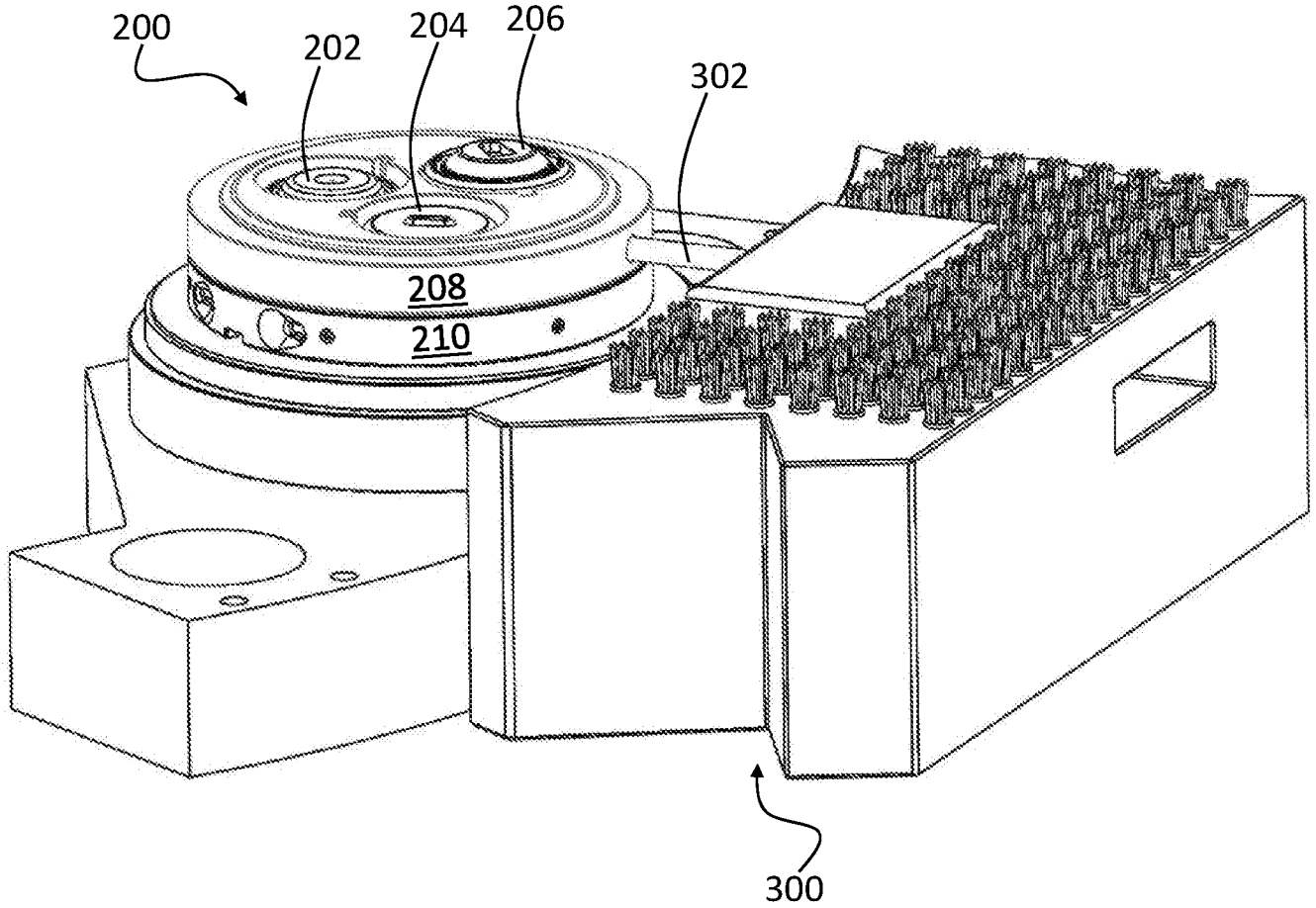
FIG. 15 is an isometric view of the multi-die carrier assembly and press apparatus shown in FIGS. 12 and 13 after rotation of the multi-die carrier base.

FIG. 15 is an isometric view of multi-die carrier assembly 200 and press apparatus 300 after rotation of cam base 210 by about 120°. By rotating cam base 210 (and the cam ramp defined by the base), forming die 206 has been elevated, and forming die 202 allowed to drop back down away from a workpiece. In various embodiments, non-selected forming dies, such as die 202, are allowed to lower if impinged on sufficiently to overcome a resilient, frictional, or elastic means holding the non-selected dies in an upper, operational position.

The example multi-tool assemblies described above are each configured with three tool sets or workstations and utilize a rotating cam to select a specific punch tool or die. It should be understood that similar multi-tools could be constructed holding 2, 4, 5, or any number of tool sets, as mentioned. In addition, various means may be employed for selectively displacing individual tools or dies for a specific working operation, in addition to or instead of the camming mechanism effected by cam base 210. For example, a sliding puck, bistable latch, or other means could be used to hold one selected die in place, as described below with reference to FIGS. 16-18. There are other variations to the configuration, means, and methods described herein which will be obvious to anyone skilled in the art.

Figure 16A:
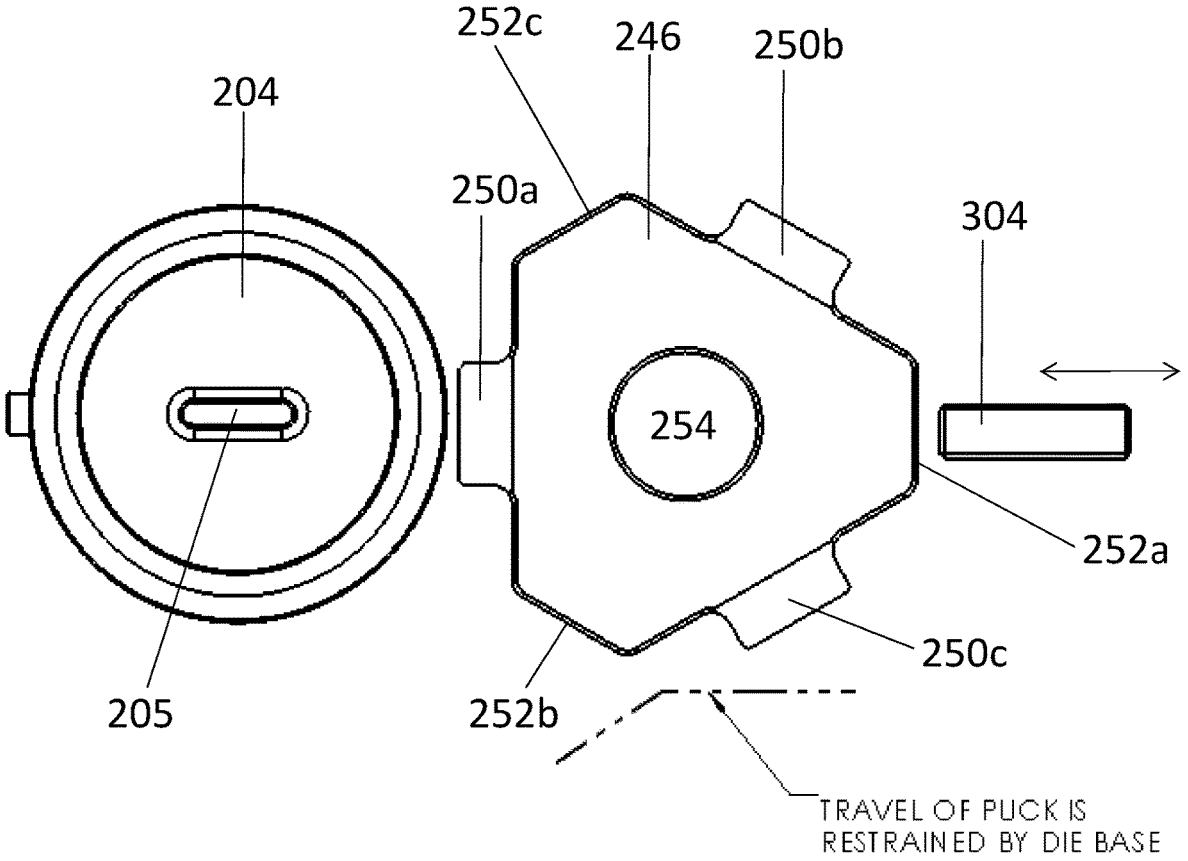
FIG. 16A is a plan view of a forming die and a slidable puck configured to effect selection and elevation of the die responsive to movement of a shot pin.

FIG. 16A is a plan view of forming die 204 and a slidable puck 246 positioned adjacent to the die. Slidable puck 246 is configured to elevate forming die 204 responsive to movement caused by a shot pin 304. In particular, slidable puck 246 defines three ramped surfaces 250*a-c* each configured to exert a camming action directly on a selected die, or an intermediate member, to raise the selected die, for example until the die rests on top of slidable puck 246, while the other die or dies remain in, or descend to, a lowered position. In some examples, non-selected dies may remain resiliently or frictionally supported, thereby rendering them moveable to a lowered position in response to gravitational and/or physical force. Each ramped surface can be positioned adjacent to a specific forming die. In the example shown, ramped surface 250*a* is positioned adjacent to forming die 204. Opposite each ramped surface 250*a-c*, a contact surface 252*a-c* is defined by slidable puck 246. Separate shot pins can contact each of the contact surfaces upon lateral movement of the shot pins, thereby moving slidable puck 246 in the direction of shot pin movement and causing one of the three ramped surfaces to move under, and elevate, the adjacent forming die via a camming mechanism. In the configuration shown, shot pin 304 is positioned to slide laterally against contact surface 252*a*, causing ramped surface 250*a* to slide under forming die 204, thereby elevating forming die 204 into an operational position against a workpiece. As further shown, slidable puck 246 may also define a central bore 254 for debris collection and lateral movement of the puck may be constrained by a die base.

Figure 16B:
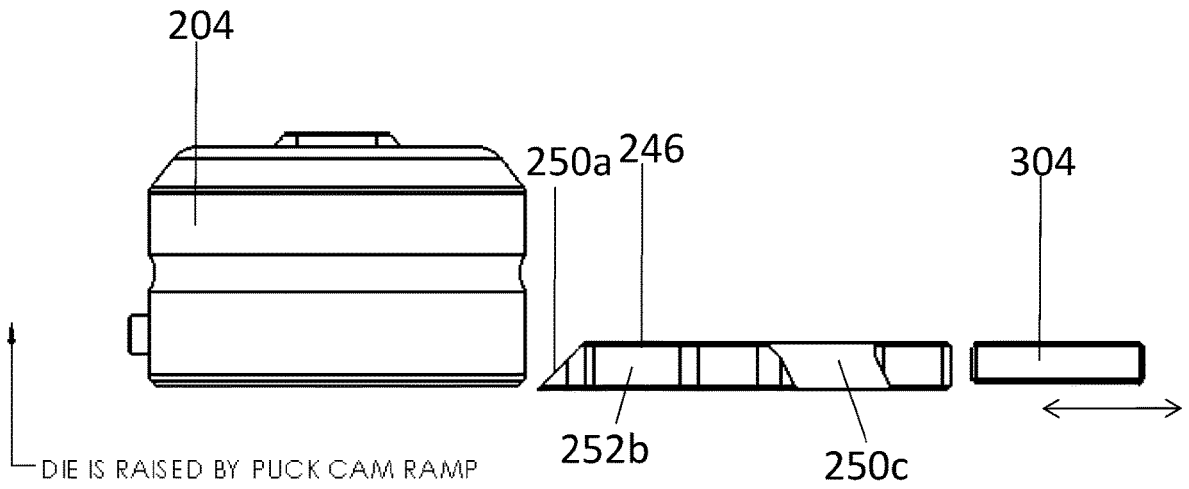
FIG. 16B is a side view of the forming die, slidable puck and shot pin of FIG. 16A.

FIG. 16B is a side view of the forming die 204, slidable puck 246 and shot pin 304. Shot pin 304 can move laterally in the directions of the bidirectional arrow. A bottom surface of slidable puck 246 may be positioned slightly beneath a bottom surface of forming die 204, such that ramped surface 250*a* can be wedged underneath the forming die upon lateral movement of the puck toward the die.

Figure 16C:
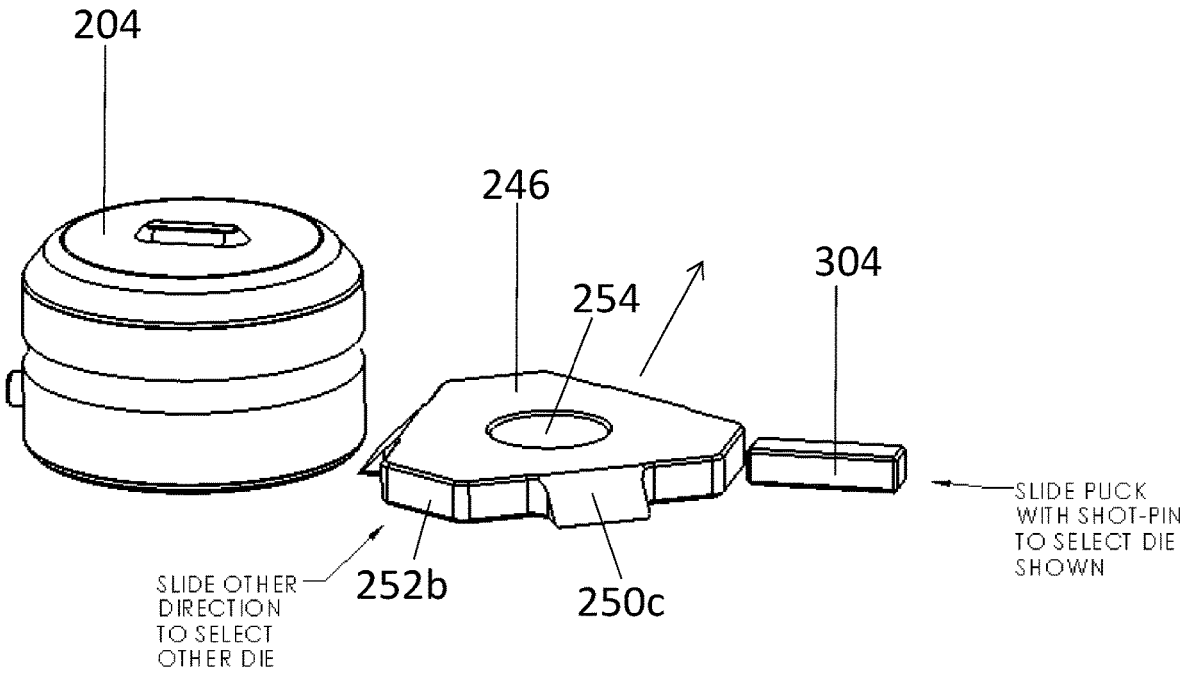
FIG. 16C is an isometric view of the forming die, slidable puck and shot pin of FIG. 16A.

FIG. 16C is an isometric view of forming die 204, slidable puck 246 and shot pin 304. As indicated, slidable puck 246 can be slid in the direction of the arrow by contacting surface 252*b* with a shot pin. In this manner, a different forming die can be selected for elevation, while non-selected forming die 204 is lowered away from the workpiece.

Figure 17A:
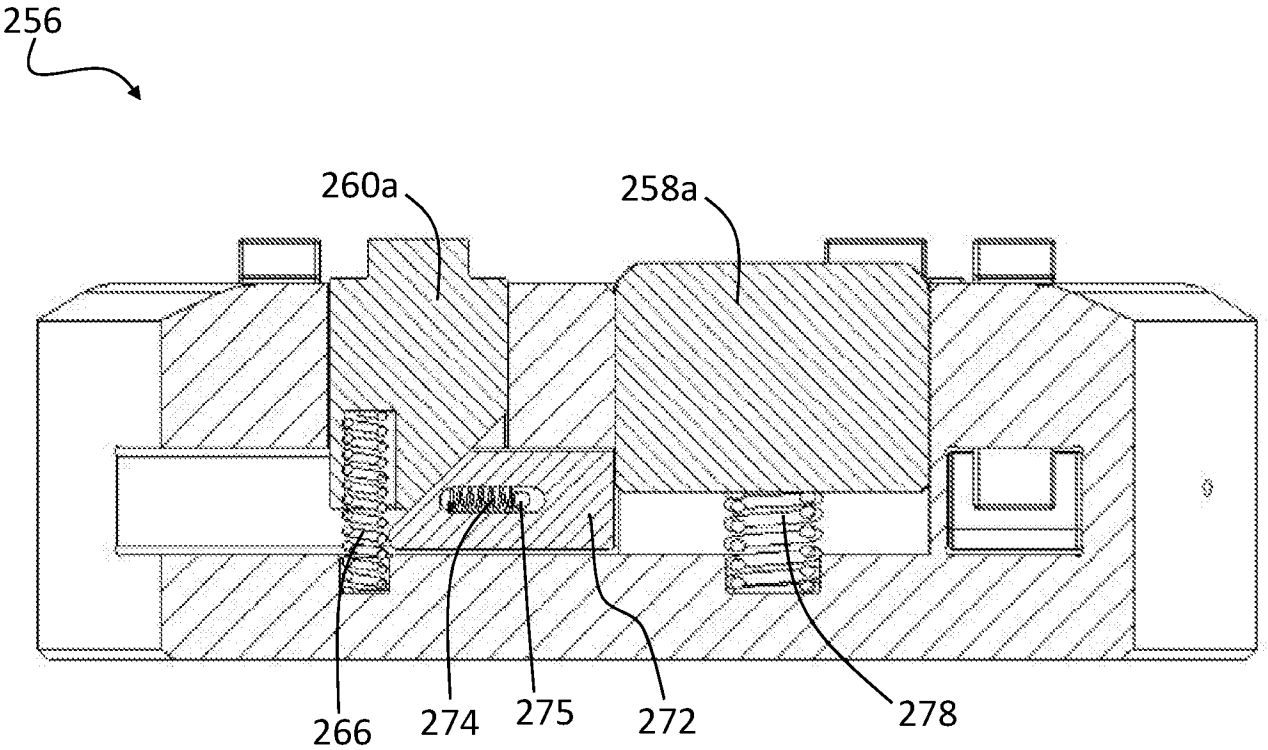
FIG. 17A is a section view of a multi-die carrier assembly having a bistable mechanism for die selection.

FIG. 17A is a section view of a multi-die carrier assembly 256 having a bistable mechanism configured for selectively raising and lowering forming dies included in the assembly, such as forming die 258*a*. Assembly 256 includes a bistable push-pin 260*a* configured to slide within the multi-die carrier assembly 256 upon receiving a force, which may be manual or mechanical, e.g., via a press operation. As further described herein, push-pin 260*a* may include an internal guideway defined by an internal cam latch member in some examples. Push-pin 260*a* is coupled at one end to a bias member, e.g., spring 266, which urges or biases the push-pin 260*a* upward (in the orientation depicted) into a first position. Another bias member, such as die spring 278, is included to bias die 258*a* toward an upward position. The force of die spring 278 may be relatively weak and less than the weight of a workpiece, thereby allowing depression or downward movement of die 258*a* in response to placement of a workpiece thereon. While push-pin 260*a* is included in the example shown in FIG. 17A, other bistable members can be utilized.

In operation, push-pin 260*a* can be depressed manually or via a punch tool, sliding deeper into assembly 256. Downward movement or depression of push-pin 260*a* may cause lateral movement of a slidable member 272 against the spring force of another bias member, e.g., spring 274, compression of which may be limited by a stop member, e.g., pin 275. Pushing downward on push-pin 260*a* a first time can maintain forming die 258*a* in an inactive, non-operational lower position, away from a workpiece. Without slidable member 272 positioned beneath forming die 258*a*, the weight and/or pressure of a workpiece positioned above the die can overcome the biasing force applied by die spring 278 that is necessary to maintain the die in an upward position, thereby compelling or allowing the die to move downward, away from the workpiece. Pushing downward on push-pin 260*a* a second time can lock forming die 258*a* in an upper position for engagement with a workpiece by moving slidable member 272 under the die, as shown in FIG. 17B.

Figure 17B:
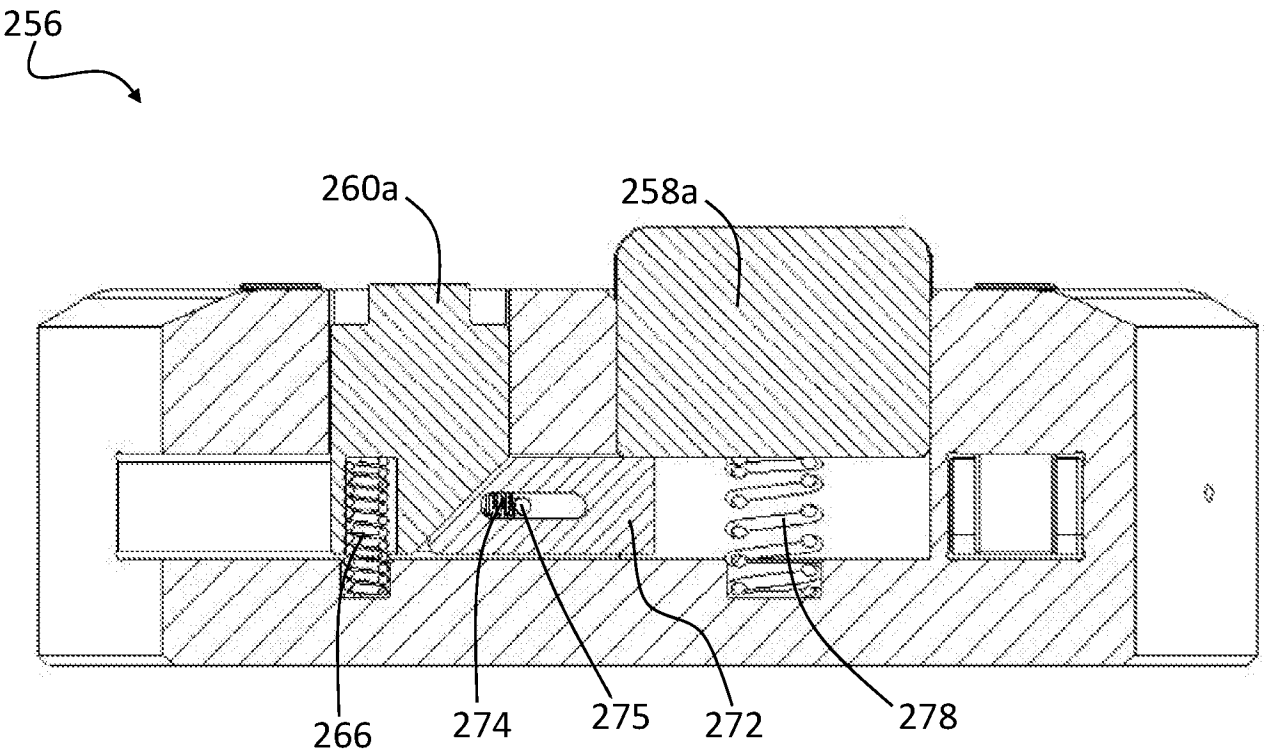
FIG. 17B is another section view of the multi-die carrier assembly of FIG. 17A.

FIG. 17B is a section view of multi-die carrier assembly 256 in a second configuration after depression of push-pin 260*a* and compression of spring 266 a second time. As shown, slidable member 272 has moved laterally in response to the downward movement of push-pin 260*a*, such that a portion of slidable member 272 is now positioned underneath forming die 258*a*, thereby preventing compression of a bias member, e.g., die spring 278, positioned underneath forming die 258*a* and locking the die in an upper, active position for engagement on a workpiece. Spring 274 has also been compressed against pin 275.

Figure 17C:
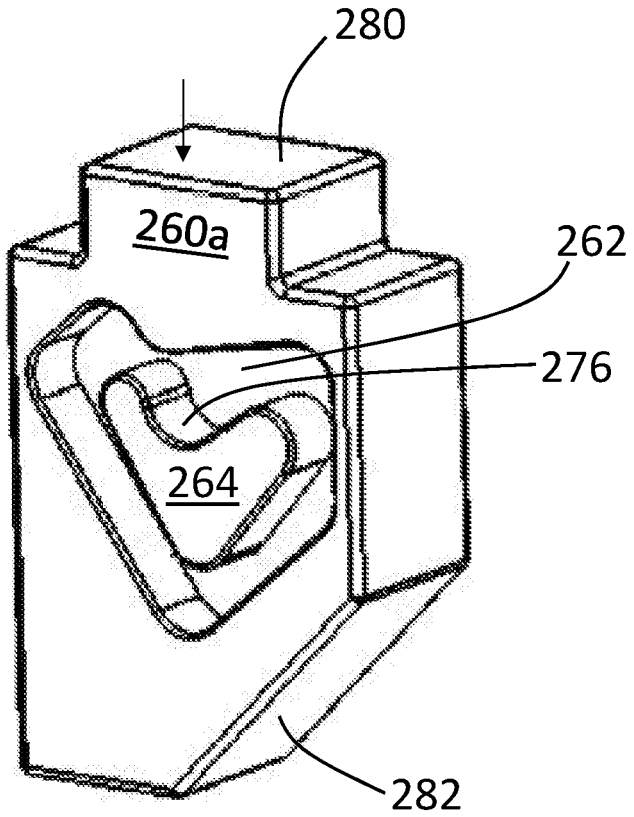
FIG. 17C is an isometric view of a bistable latch component.

FIG. 17C is an isometric view of push-pin 260*a*, showing a guideway 262 and a cam latch member 264. A pocket 276 is also shown, along with an interface 280 configured to receive a force in the direction of the arrow to effect locking and unlocking of an operatively coupled forming die into active and inactive configurations. Slanted surface 282 is configured to slide against a complementary surface defined by slidable member 272 during actuation of push-pin 260*a*. A locking member can also be coupled with push-pin 260*a* and may include a lateral protrusion confined to the guideway. In some examples, a lateral protrusion defined by a locking member may rest in pocket 276 defined by cam latch member 264, thereby locking push-pin 260*a* in a locked configuration until it is depressed again at interface 280. The locking member can also be coupled with slidable member 272. Depression of push-pin 260*a* may cause a lateral protrusion of the locking member to be repositioned within guideway 262.

Figure 17D:
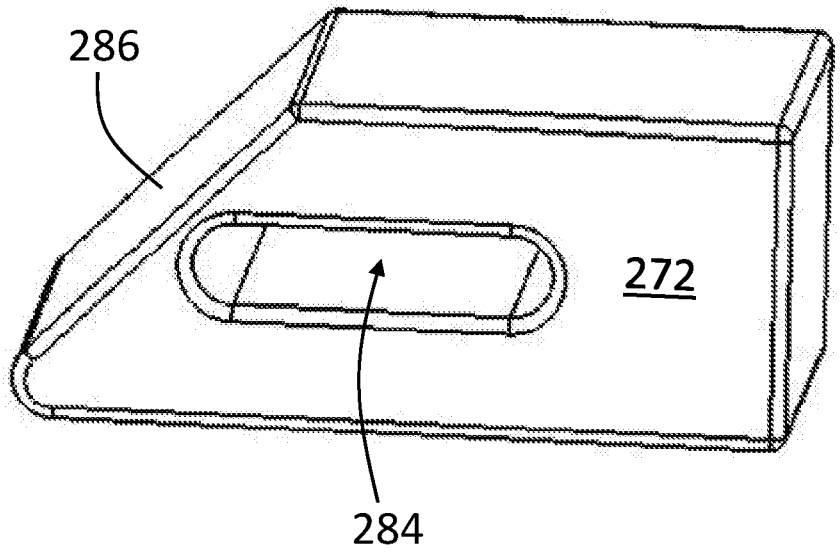
FIG. 17D is an isometric view of a slidable cam component.

FIG. 17D is an isometric view of slidable member 272. As shown, slidable member 272 can define a lateral aperture 284 and a slanted surface 286 that is complementary to the slanted surface 282 defined by push-pin 260*a*. Lateral aperture 284 may house spring 274 and pin 275.

Figure 17E:
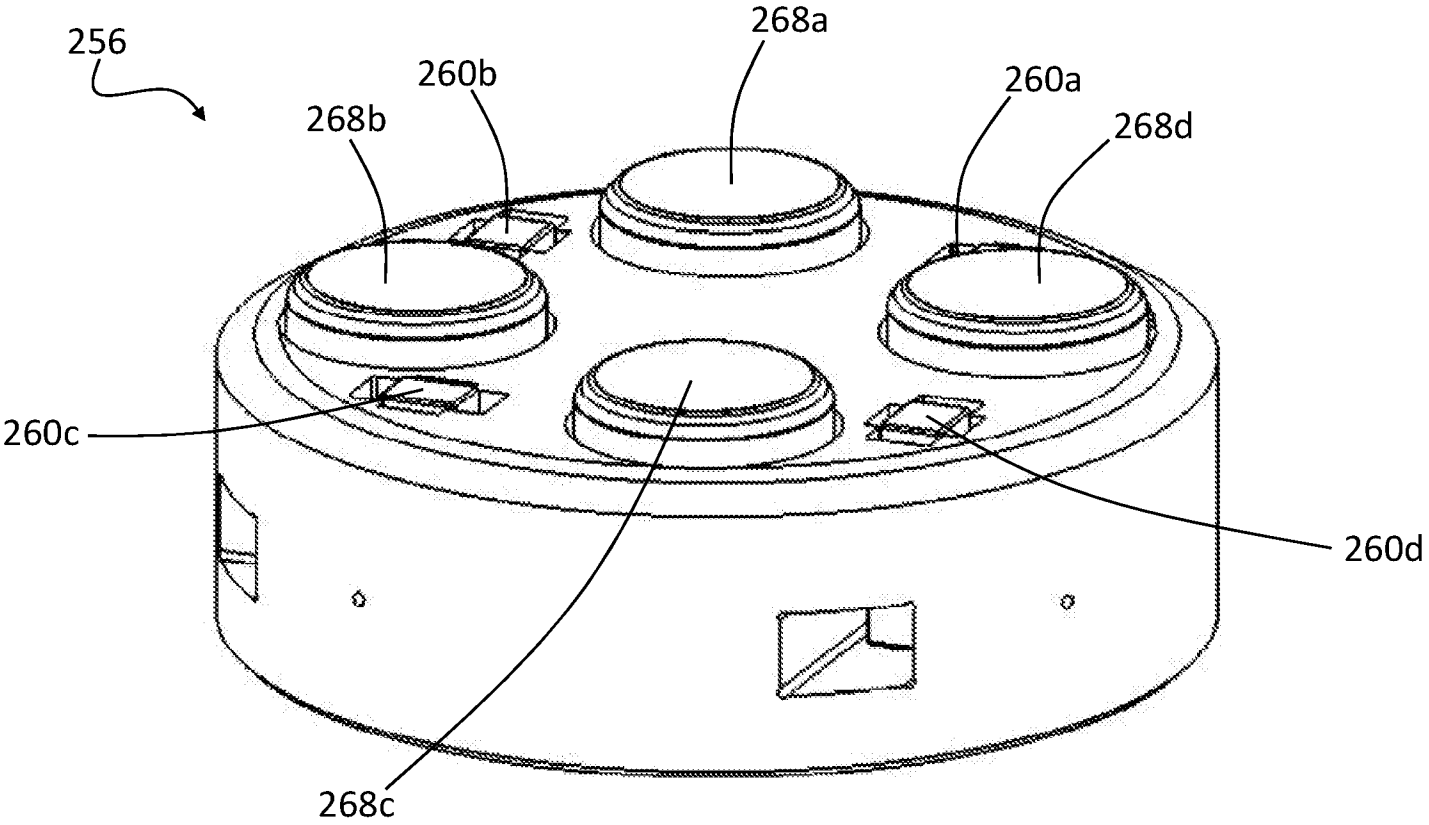
FIG. 17E is an isometric view of the multi-die carrier assembly of FIG. 17A.

FIG. 17E is an isometric view of multi-die carrier assembly 256 that includes four forming dies 268*a*-268*d* each coupled with a respective push-pin 260*a*-260*d*. Due to the independent coupling between each push-pin-forming die pair, the forming dies can be selectively activated one-by-one for operation on a workpiece.

Figure 18:
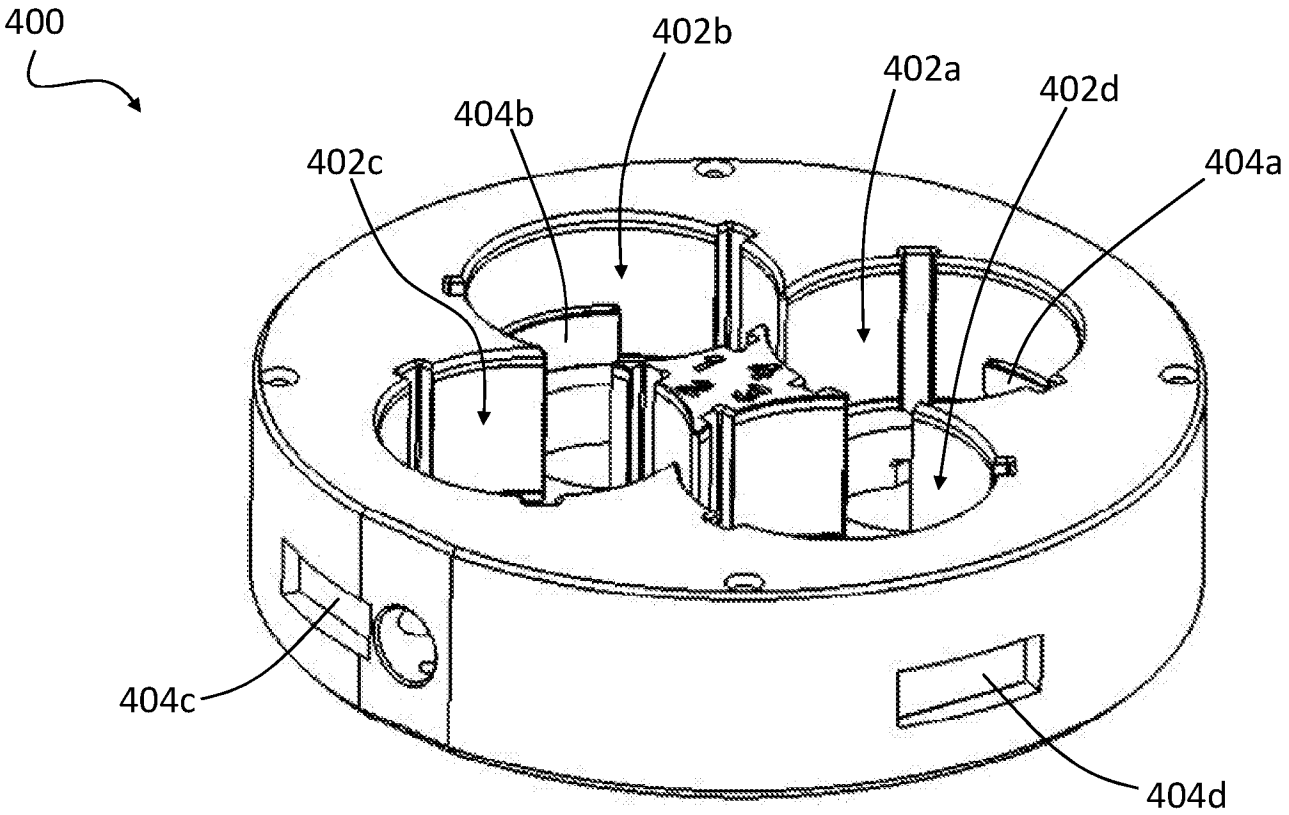
FIG. 18 is an isometric view of a multi-die carrier assembly comprising latch mechanisms for die selection.

FIG. 18 is an isometric view of a multi-die carrier assembly 400 comprising latch mechanisms for individual die selection. Die carrier assembly 400 defines four die bores 402*a-d*, each configured to receive a movable forming die therein. Each forming die can be raised by one or more springs positioned beneath each die. After raising a die via the spring(s), a shelf-like component or latch 404*a, b, c* or *d* can be slid underneath the die, holding the die at an elevated position for operation on a workpiece. In this manner, individual die selection is effected by sliding a latch under its respective die. One or more latches may be moveable in response to manually or mechanically applied forces, e.g., via a press operation.

Figure 19A:
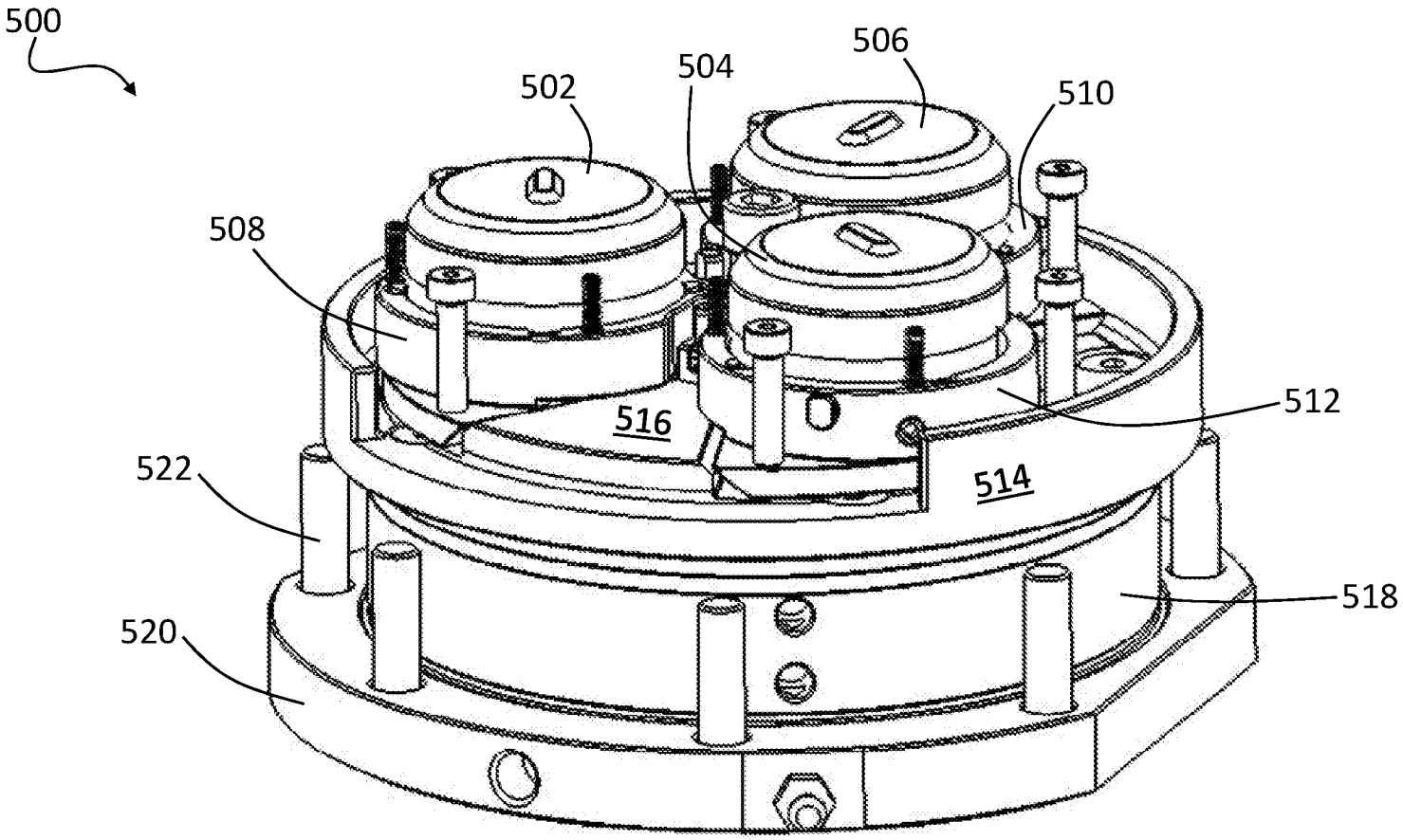
FIG. 19A is an isometric, partially cut-away view showing internal components of a multi-die carrier assembly configured to selectively actuate individual dies using a machine fork component in conjunction with a cam ramp in accordance with principles of the present disclosure.

FIG. 19A is a partially cut-away isometric view showing internal components of a multi-die carrier assembly 500 configured to selectively actuate individual forming dies using a machine fork component in conjunction with a cam ramp. Not shown for clarity is the die locator component 526 of FIG. 19B, which holds the dies and facilitates rotation thereof. Selective die actuation may be facilitated by both stationary and rotatable components in the embodiment shown. Rotatable components of die carrier assembly 500 can include one or more forming dies, such as dies 502, 504 and 506, each of which may be set in a respective die sleeve 508, 510, 512. Stationary components coupled with the dies 502, 504, 506 can include a plate 514, which includes a cam ramp 516 configured to elevate individual dies upon die locator component rotation, and a sub-plate 518 integrally formed with or affixed to a base 520. A plurality of fasteners 522, e.g., socket head screws, can also be included to mount die assembly 500 to a platform or work surface.

In operation, dies 502, 504, 506 can be configured to rotate within plate 514 and over cam ramp 516, such that one of the dies may be elevated by cam ramp 516 at any given point in time. In some embodiments, such as shown in FIG. 19A, cam ramp 516 may be sized to fit between any two dies, such that if desired by an operator, none of the dies are elevated at a given point in time. Rotation of the die locator component may be driven by a mechanical rotator, such as the machine fork 529 shown in FIG. 19C.

Figure 19B:
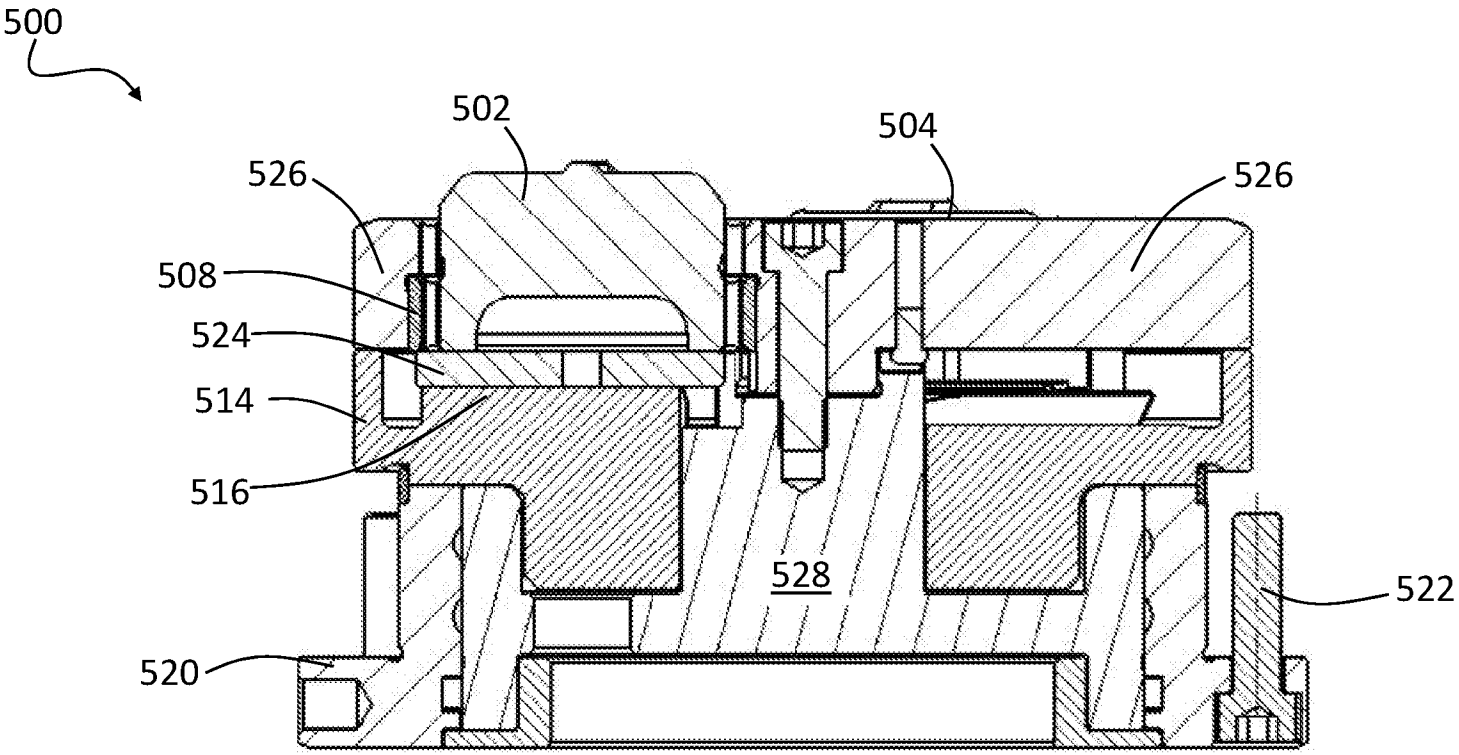
FIG. 19B is a section view of the multi-die carrier assembly of FIG. 19A, showing a die in an operational position.

FIG. 19B is a section view of die carrier assembly 500, showing die 502 raised to an elevated operating position, where it may contact and form a workpiece. Die 502 is positioned above a die shoe 524 and partially within die sleeve 508. As further shown, an interior portion of plate 514 defines cam ramp 516, which may define one or more slanted surfaces configured to wedge beneath each die upon rotation thereof. A die locator component 526 coupled with plate 514 may conceal the majority of each die, such that only an upper portion of each die is visible. In the configuration shown, die 502 remains elevated in an operating position atop cam ramp 516, such that a greater portion of die 502 is visible relative to die 504, which along with die 506, remains retracted in a non-operational, or resting, position. Each die is further supported by a centrally-positioned, rotatable driver 528, which may be configured to rotate in response to rotation of a mechanical rotator.

Figure 19C:
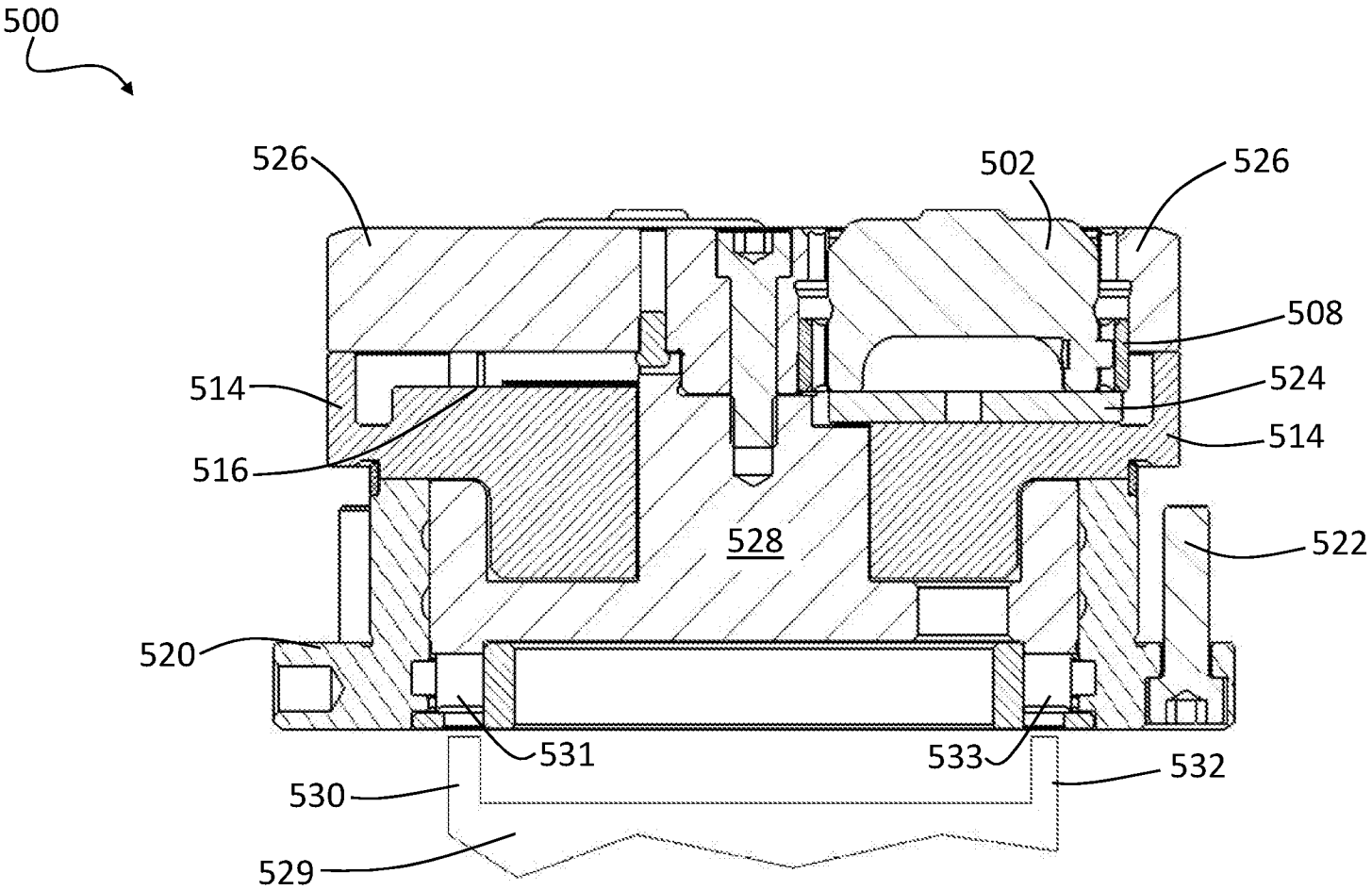
FIG. 19C is another section view of the multi-die carrier assembly of FIG. 19A after rotation of the dies therein.

FIG. 19C is a section view of die carrier assembly 500 after rotation of the dies, such that die 502 is now positioned on the right-hand side of the illustration. As shown, die shoe 524 and die sleeve 508 have both been repositioned via rotation, while plate 514 and cam ramp 516 remain stationary. In this specific configuration, none of the dies have been positioned over cam ramp 516, such that each die is in a retracted, non-operational position. Rotation of the dies can be driven by mechanical rotation of machine fork 529, which comprises at least one protrusion, prong or fork, such as fork 530 and fork 532. Each fork 530, 532 can be configured for slidable insertion within a respective slot 531, 533 defined by or coupled with rotatable driver 528. Accordingly, rotation of machine fork 529 may drive rotation of driver 528 and dies 502, 504, 506 supported thereon. Movement of machine fork 529 may be effected by various components, such as a machine belt or mechanical gear system.

Figure 19D:
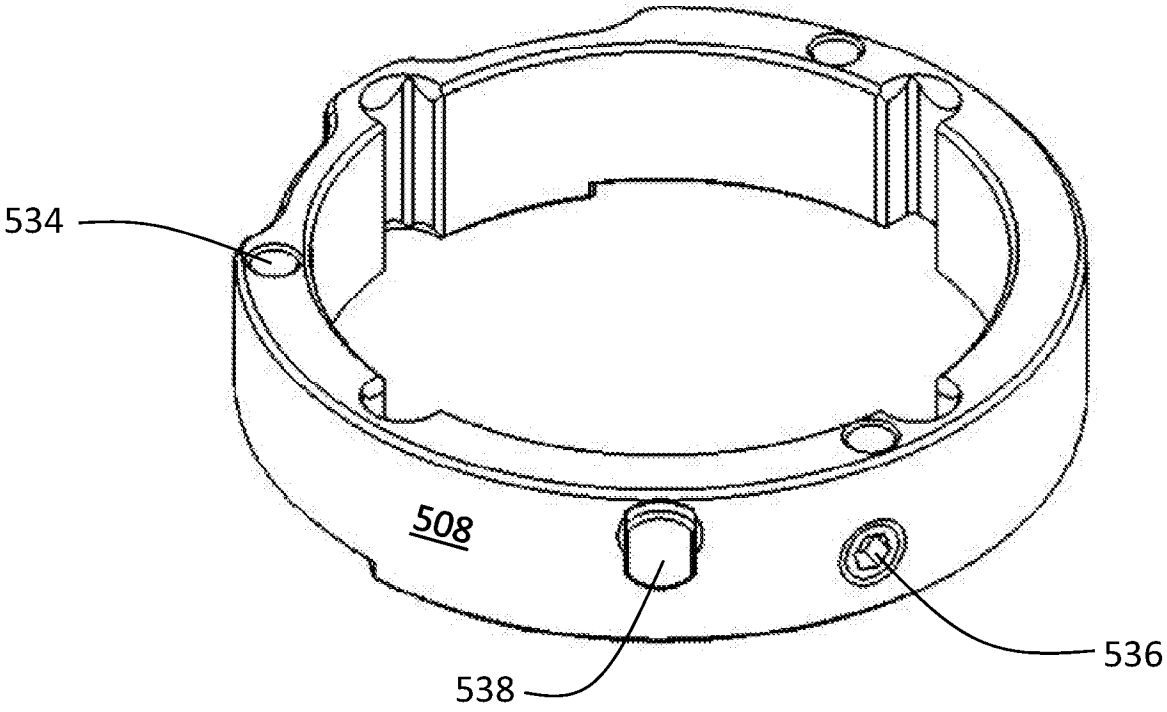
FIG. 19D is an isometric view of a die sleeve configured for coupling with a die in accordance with principles of the present disclosure.

FIG. 19D is an isometric view of die sleeve 508, which can be configured to limit the vertical mobility of a die coupled therewith. For example, die sleeve 508 can be configured to limit the upward movement of a die coupled therewith, such that if a workpiece adheres to an upper surface of the die, removal of the workpiece causes separation of the workpiece from the die. One or more vertical holes or slots 534 may be defined by die sleeve 508, each vertical hole or slot configured to receive a coil spring configured to urge or compel non-selected dies in a downward direction, away from the workpiece. Die sleeve 508 may also include one or more horizontally positioned fasteners, e.g., set screw 536, configured to couple die sleeve 508 with a corresponding die. A die key 538 may also be included with die sleeve 508, the die key 538 configured to orient the die to which it is coupled with one of the die bores defined by a die locator component, such as die locator component 526. Die sleeves may be coupled with one or more of the dies in some examples, or, in other examples, excluded entirely.

Figure 20A:
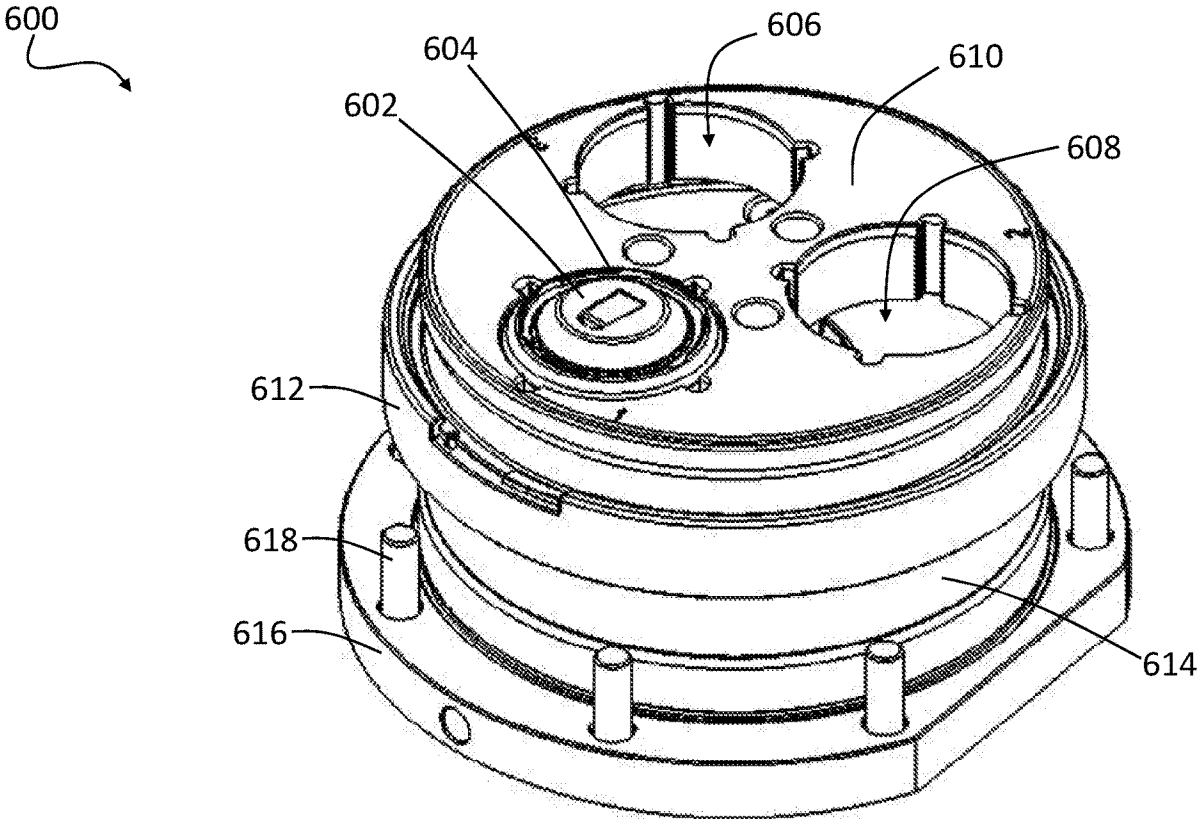
FIG. 20A is an isometric view of a multi-die carrier assembly configured to selectively actuate individual dies using a mechanical rotator.

FIG. 20A is an isometric view of a multi-die carrier assembly 600 configured to selectively actuate individual dies using a machine fork component. Like multi-die carrier assembly 500, multi-die carrier assembly 600 can include a combination of rotatable and stationary components. As shown, die carrier assembly 600 can include one or more rotatable forming dies, such as die 602, each die housed in a respective die bore 604, 606, 608 defined by a rotatable die locator component 610. Stationary components can include a plate 612 which includes a sub-plate 614 integrally formed with or affixed to a base 616, which may be coupled with one or more fasteners 618 configured to mount die assembly 600 to a platform or work surface.

In operation, die bores 604, 606, 608, and any dies mounted therein, and die locator component 610, can rotate within plate 612. Rotation of the die locator component 610 may again be driven by a separate mechanical component, such as the machine fork shown 620 in FIG. 20B, which unlike machine fork 529, can be configured to rotate and lift the dies, thereby effecting selection and elevation of each die at the direction of an operator.

Figure 20B:
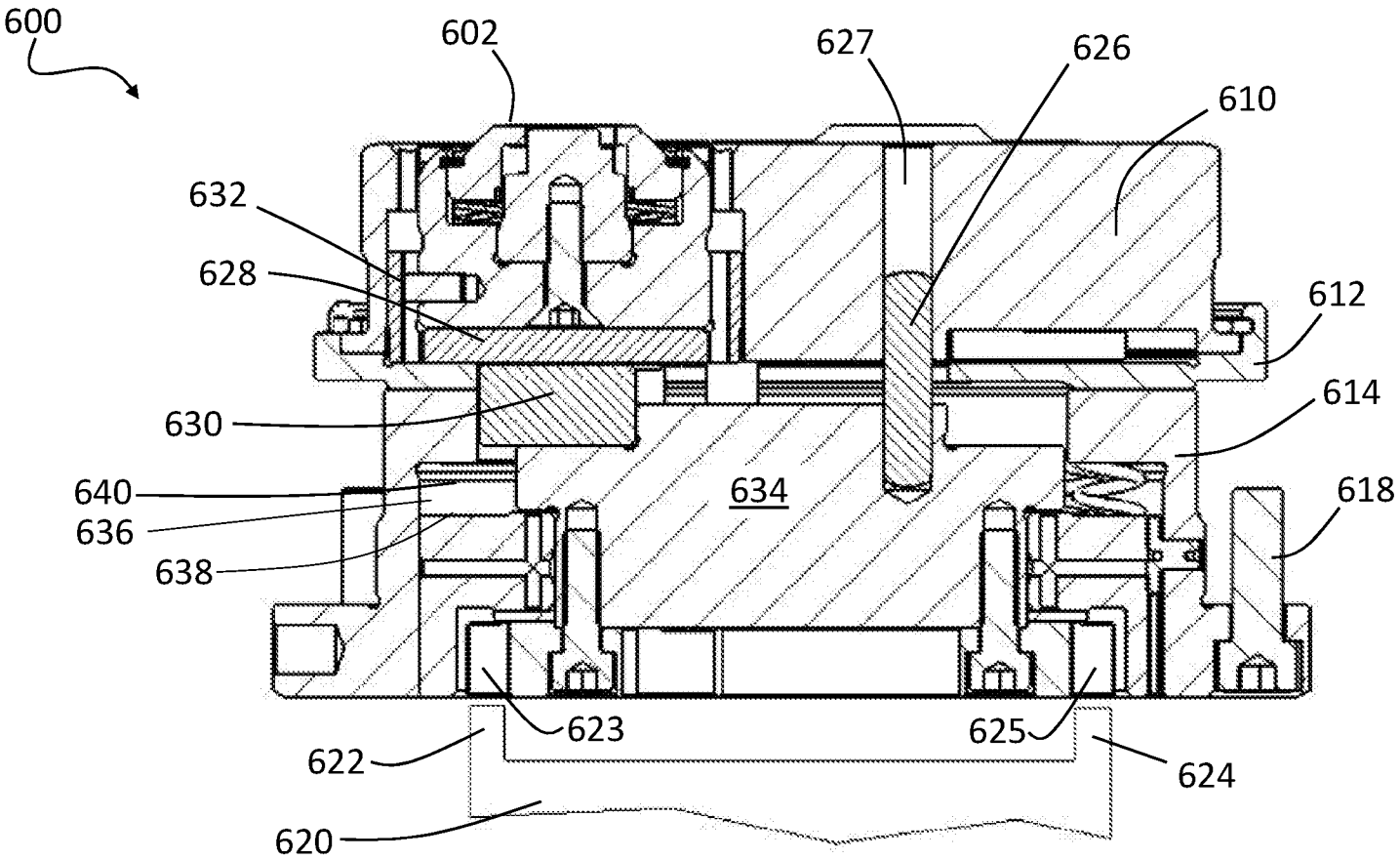
FIG. 20B is a section view of the multi-die carrier assembly of FIG. 20A, showing a die in a non-operational position.

FIG. 20B is a section view of multi-die carrier assembly 600, showing die 602 in a retracted, non-operational position. As shown, die locator component 610 can define a slot or hole 627 configured to receive a carrier pin 626, which moves vertically within the hole or slot in response to elevation and retraction of driver component 634. Upward motion of driver component 634 drives upward movement of lift block 630, thereby causing upward motion of die shoe 628 and die 602, along with die sleeve 632 coupled therewith.

Elevation of die 602 can be limited by the size of lift gap 636. In particular, driver component 634 may continue to elevate until an upper gap surface 638 of the driver component contacts a ceiling 640 of lift gap 636. Rotation of driver component 634 and any dies coupled therewith can be driven by mechanical rotation of machine fork 620, which comprises at least one prong or fork, such as fork 622 and fork 624. Each fork 622, 624 can be configured for slidable insertion within a respective slot 623, 625 defined by or coupled with driver component 634. Accordingly, rotation and elevation of machine fork 620 may drive rotation and elevation of driver component 634 and die 602. Movement of machine fork 620 may be effected by various components, such as a machine belt or mechanical gear system.

Figure 20C:
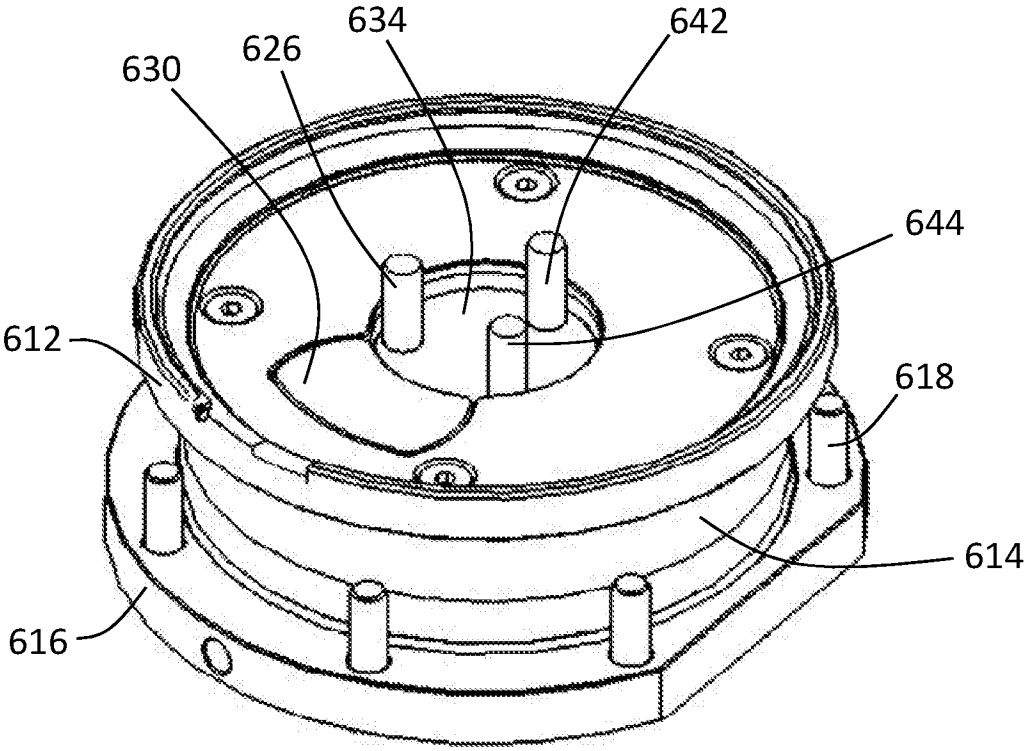
FIG. 20C is an isometric view of the multi-die carrier assembly of FIG. 20A without a rotatable die carrier and any forming dies.

FIG. 20C is an isometric view of multi-die carrier assembly 600 without rotatable die locator component 610 and any forming dies coupled therewith installed. With rotatable die locator component 610 removed, an upper surface of driver component 634 is exposed, along with carrier pins 626, 642 and 644, each of which may be pressed directly into the driver component. As driver component 634 rises, the carrier pins 626, 642, 644 slide vertically within respective holes or slots defined by die locator component 610, thereby accommodating vertical motion of driver component 634 without causing vertical motion of die locator component 610. Rotation of carrier pins 626, 642, 644 causes rotation of die locator component 610, such that die locator component 610 can rotate, but not rise/fall, with driver component 634. To drive vertical motion of an individual forming die without a cam ramp, lift block 630 is positioned in a retained pocket that confines it to vertical motion, only. When the desired forming die is rotated to the position above lift block 630 via driver component 634, lift block 630 is urged upward via vertical motion of driver component 634.

Figure 21:
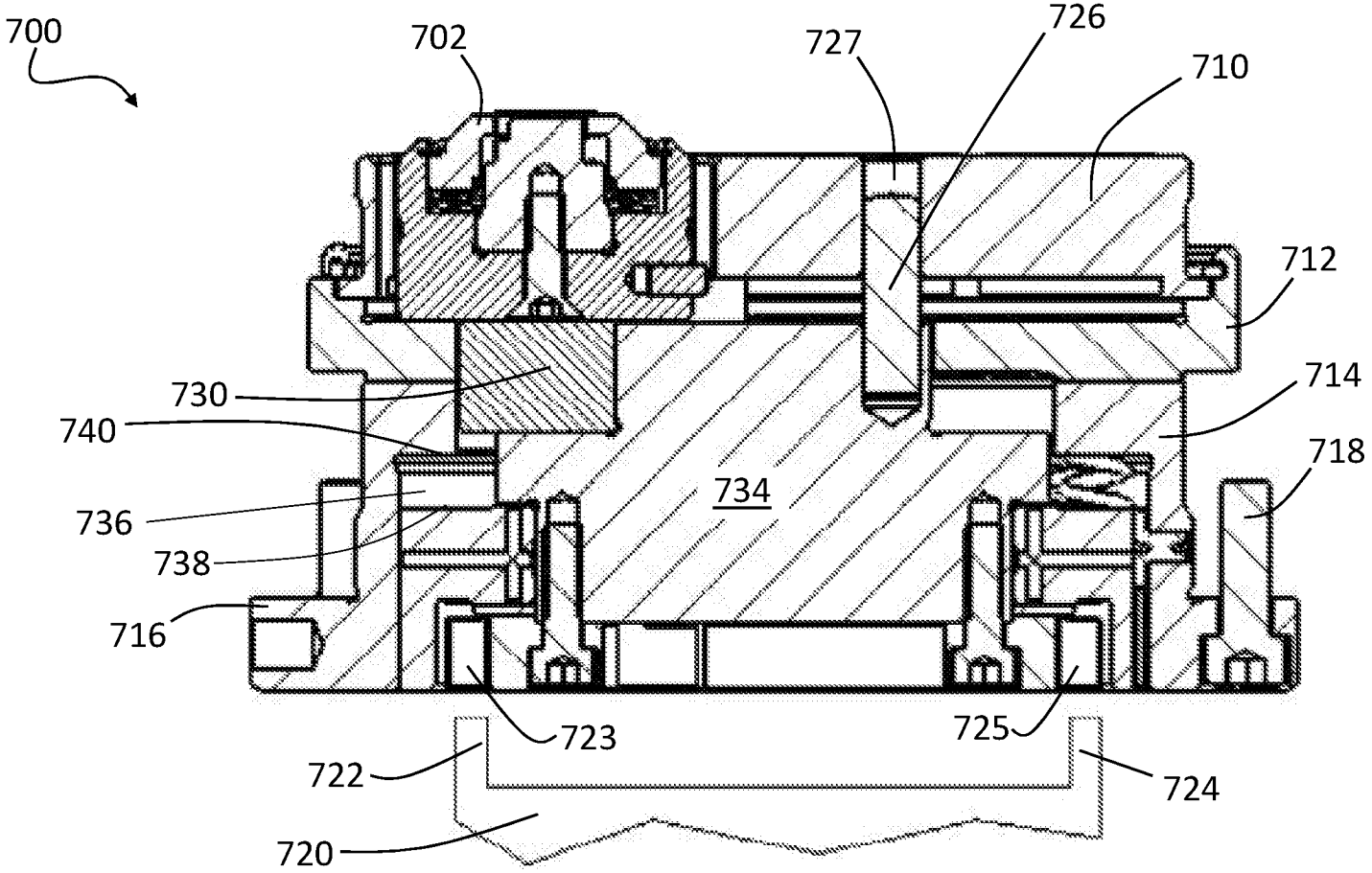
FIG. 21 is a section view of a multi-die carrier assembly configured to selectively actuate individual dies using a mechanical rotator.

FIG. 21 is a section view of a of multi-die carrier assembly 700, showing a die 702 in a non-elevated, non-operational position. In this particular embodiment, die sleeves are not included with the assembly 700. As a result, die 702 can slide up and down without the additional restriction of the die sleeves. Like multi-die carrier assembly 600, multi-die carrier assembly 700 is configured to selectively actuate individual dies using a mechanical rotator, such as machine fork 720. Multi-die carrier assembly 700 can include a combination of rotatable and stationary components, including one or more rotatable forming dies, such as die 702, each die housed in a respective die bore defined by a rotatable die locator component 710. Stationary components can include a plate 712 which includes a sub-plate 714 integrally formed with or affixed to a base 716, which may be coupled with one or more fasteners 718 configured to mount die assembly 700 to a platform or work surface.

In operation, die locator component 710 and die 702 can rotate within plate 712. Rotation of die locator component 710 may be driven by a separate mechanical component, such as the machine fork shown 720, which can be configured to rotate, lift and support the dies, thereby effecting selection and elevation of each die at the direction of an operator.

As further shown, die carrier 710 can define a slot or hole 727 configured to receive a carrier pin 726, which moves vertically within the hole or slot in response to elevation and retraction of driver component 734. Upward motion of driver component 734 drives upward movement of lift block 730, thereby causing upward motion of die 702.

Elevation of die 702 can be limited by the size of a lift gap 736. In particular, driver component 734 may continue to elevate until an upper gap surface 738 of the driver component contacts a ceiling 740 of lift gap 736. Rotation of driver component 734 and any dies coupled therewith can be driven by mechanical rotation of machine fork 720, which comprises at least one prong or fork, such as fork 722 and fork 724. Each fork 722, 724 can be configured for slidable insertion within a respective slot 723, 725 defined by or coupled with driver component 734. Accordingly, rotation and elevation of machine fork 720 may drive rotation and elevation of driver component 734 and die 702. Movement of machine fork 720 may be effected by various components, such as a machine belt or mechanical gear system.

The above Detailed Description is intended to be illustrative and not restrictive. The above-described embodiments (or one or more features or components thereof) can be used in varying combinations with each other unless clearly stated to the contrary. Other embodiments can be used, such as by one of ordinary skill in the art upon reviewing the above Detailed Description. Also, various features or components have been grouped together to streamline the disclosure. This should not be interpreted as intending that an unclaimed disclosed feature is essential to any claim. Rather, inventive subject matter can lie in less than all features of a particular disclosed embodiment. Thus, the following additional examples are hereby incorporated into the Detailed Description, with each example standing on its own as a separate embodiment. While this invention has been described with respect to particular examples and embodiments, changes can be made and substantial equivalents can be substituted in order to adapt these teaching to other configurations, materials and applications, without departing from the spirit and scope of the invention. The invention is thus not limited to the particular examples that are disclosed, but encompasses all the embodiments that fall with the scope of the claims.

EXAMPLES

In Example 1, a multi-die carrier assembly can include a first component configured to locate a plurality of forming dies with lateral precision. The multi-die carrier assembly can further include a second component (or components) coupled with the first component and defining a cam or ramp configured to selectively elevate one of the dies within the coupled assembly.

In Example 2, the carrier assembly of Example 1 can optionally be configured to further include a lock pin. The lock pin can be configured to move or slide at the direction of a user to lock the assembly such that in a locked configuration, the first component and the second component are fixed with respect to each other, and in the unlocked configuration, one component is rotatable with respect to the other component.

In Example 3, the carrier assembly of Example 2 can optionally be configured such that the lock pin is configured to slide responsive to engagement by a shot pin of a press apparatus positioned adjacent to the carrier assembly.

In Example 4, the carrier assembly of Example 1 can optionally be configured to simultaneously hold two, three, four or more forming dies.

In Example 5, the carrier assembly of Example 1 can optionally be configured such that one forming die can be selectively elevated to an operating position, while the remaining dies remain at a first, lower position.

In Example 6, the carrier assembly of Example 1 can optionally be configured such that all forming dies can remain at a lower position, at least until selective elevation of one of the forming dies.

In Example 7, the carrier assembly of Example 1 can optionally be configured to further include a die shoe or die sleeve coupled with each forming die.

In Example 8, a method of selecting forming dies for operation from a multi-die carrier assembly comprising a die locating component and die lifting component can involve unlocking the multi-die carrier assembly; rotating one component of the multi-die carrier assembly relative to a stator component of the assembly until a selected die is elevated to a working position, wherein rotating the components relative to each other elevates one die at a time; and then locking the multi-die carrier assembly.

In Example 9, the method of Example 8 can optionally be configured such that the multi-die carrier assembly comprises a slidable pin member coupled with the stator component and configured to receive an external pushing force to lock or unlock said coupled components.

In Example 10, the method of Example 8 can optionally be configured such that the base component defines a cam ramp, the cam ramp configured to slide under each die in response to rotation of the base component.

In Example 11, the method of Example 8 can optionally be configured such that the base component defines a cam ramp, wherein said base component is a stator member and the upper die locating component is configured to rotate to slide a selected die onto the cam ramp in response to rotation of the upper component.

In Example 12, the method of Example 8 can optionally be configured such that the multi-die carrier assembly is mounted on a press apparatus, the press apparatus configured for rotating the coupled components relative to each other.

In Example 13, the method of Example 8 can optionally be configured such that the press apparatus is configured for actuating a shot pin aligned with the slidable lock pin member.

In Example 14, a forming punch and die set and selection apparatus, or forming multi-tool, can be configured to work cooperatively with an automated punch press to select one of a set of punches and dies to operate within the apparatus to be engaged with the a load-applying ram and tool holders, and to compel or allow the non-selected die or dies to be moved away from a sheet material or workpiece.

In Example 15, the multi-tool of Example 14 can optionally be configured such that a lower section of the apparatus, or multiple die holder apparatus, is manipulable by automated press actuation to raise one selected die up to a useful working position while the other die or dies remain substantially lower.

In Example 16, the multi-tool of Example 15 can optionally be configured such that the multiple die holder apparatus is manipulable by the automated press to allow all of the forming dies to remain in a lower, or non-selected position.

In Example 17, the multi-tool of Example 14 can optionally be configured such that the lower section of the apparatus, or multiple die holder apparatus, holds one die rigidly while the other die or dies are allowed to lower if impinged on sufficiently to overcome a resilient, frictional, or elastic means holding said non-selected dies in an upper position.

In Example 18, the multi-tool of Example 14 can optionally be configured such that the selected die is raised by a rotatable cam ramp.

In Example 19, the multi-tool of Example 18 can optionally be configured such that the selected die is raised by camming action of the rotatable cam ramp, acting directly on the dies or, an intermediate member to raise the selected die, while the others remain in, or descend to, a lowered position.

In Example 20, the multi-tool of Example 15 can optionally be configured such that the selected die is supported by a raised portion of a rotatable selector so as to be supported solidly enough for material forming, while the other die or dies are only resiliently or frictionally supported, and may be moveable to a lowered position.

In Example 21, the multi-tool of Example 15 can optionally be configured such that the selected die is raised by a slidable puck which can be positioned between the dies and die holder, to support one selected die while the other die or dies may be lowered.

In Example 22, the multi-tool of Example 14 can optionally be configured such that a die is selected by a bistable vertical locking mechanism.

In Example 23, the multi-tool of Example 14 can optionally be configured such that one die is selected for operation by moving a slidable latch or other supporting member to hold said selected die in a useful position for forming, each die position having its own said slidable latch.

In Example 24, the multi-tool of Example 14 can optionally be configured such that one die is selected for operation by moving a rotatable latch, collar, or other supporting member to hold said selected die in a useful position for forming, each die position having its own said rotatable latch.

In Example 25, a method of selecting a die using the multi-tool of Example 14 can optionally be configured such that one part of the die holding apparatus is rotated relative to another, such that a rotatable cam ramp is rotated relative to the dies, thus facilitating lifting and/or support of the selected die.

In Example 26, a method of selecting a die using the multi-tool of Example 21 can optionally be configured such that selecting the die involves moving the slidable puck laterally relative to another part of the die holding apparatus, such that the selected die is lifted or supported sufficiently for sheet material forming.

In Example 27, a method of selecting a die using the multi-tool of Example 22 can optionally be configured such that selecting the die involves actuating the bistable mechanism via press operation or manipulation, thereby raising and/or supporting one die to a useful position for forming sheet material.

In Example 28, a method of selecting a die using the multi-tool of Example 23 can optionally be configured such that selecting the die involves actuating the slidable latch via press operation or manipulation so as to support one die at a useful position for forming sheet material.

In Example 29, a method of selecting a die using the multi-tool of Example 24 can optionally be configured such that selecting the die involves actuating the rotatable latch via press operation or manipulation so as to support one die at a useful position for forming sheet material.

In Example 30, the multi-tool of Example 14 can optionally be configured such that the die selection apparatus, in addition to raising a selected die, also retracts, or positively displaces the non-selected die or dies in a downward position.

This invention has been described with respect to particular examples and embodiments. Changes can be made and equivalents can be substituted in order to adapt these teachings to other configurations, materials and applications, without departing from the spirit and scope of the disclosure. The invention is thus not limited to the particular examples that are disclosed, but encompasses all embodiments that fall with the scope of the claims.

The invention claimed is:

1. A multi-die carrier assembly, comprising:

a die locator configured to retain a plurality of forming dies; and a cam base coupled with the die locator and configured to select one of the plurality of forming dies for operation on a workpiece by retaining or elevating the selected forming die at an operational height, wherein the die locator and the cam base define complementary mating surfaces that form a slidable interface configured to accommodate relative motion between the die locator and the cam base;

wherein the cam base defines a cam or a ramp configured to slide beneath each of the plurality of forming dies upon the relative motion between the die locator and the cam base; and wherein the die locator is rotatable with respect to the cam base and the cam base is configured to remain stationary.

2. The assembly of claim 1, wherein the cam or the ramp is configured to elevate and retain each of the plurality of forming dies at the operational height upon sliding beneath each of the plurality of forming dies.

3. The assembly of claim 1, wherein dies not selected for operation on the workpiece are compelled or allowed to move to a non-operational height away from the workpiece.

4. The assembly of claim 3, wherein the cam base is further configured to retract or positively displace the dies not selected for operation on the workpiece.

5. The assembly of claim 3, wherein the dies not selected for operation on the workpiece remain resiliently or frictionally supported, such that said dies not selected for operation on the workpiece are moveable to the non-operational height in response to a gravitational and/or physical force.

6. A multi-die carrier assembly, comprising:

a die locator configured to retain a plurality of forming dies; and a cam base coupled with the die locator and configured to select one of the plurality of forming dies for operation on a workpiece by retaining or elevating the selected forming die at an operational height;

wherein the die locator and the cam base define complementary mating surfaces that form a slidable interface configured to accommodate relative motion between the die locator and the cam base;

wherein the die locator is further configured to receive a lock pin, the lock pin configured to slide within an aperture defined by the die locator; and wherein sliding of the lock pin causes the assembly to switch between a locked configuration and an unlocked configuration, wherein the lock pin is biased toward the locked configuration.

7. The assembly of claim 6, wherein in the locked configuration, the die locator and the cam base are fixed with respect to each other, and in the unlocked configuration, the cam base is rotatable with respect to the die locator, with the die locator configured to remain stationary.

8. The assembly of claim 6, wherein the lock pin is configured to slide responsive to engagement by a pin member of a press apparatus positioned adjacent to the assembly.

9. A multi-die carrier assembly, comprising:

a die locator configured to retain a plurality of forming dies; and a cam base coupled with the die locator and configured to select one of the plurality of forming dies for operation on a workpiece by retaining or elevating the selected forming die at an operational height;

wherein the die locator and the cam base define complementary mating surfaces that form a slidable interface configured to accommodate relative motion between the die locator and the cam base; and further comprising a plurality of die shoes, wherein each of the plurality of die shoes is biased away from a bottom surface of one of the plurality of forming dies.

10. A multi-die carrier assembly, comprising:

a die locator configured to retain a plurality of forming dies; and a cam base coupled with the die locator and configured to select one of the plurality of forming dies for operation on a workpiece by retaining or elevating the selected forming die at an operational height;

wherein the die locator and cam base define complementary mating surfaces that form a slidable interface configured to accommodate relative motion between the die locator and the cam base; and further comprising a mechanical rotator configured to rotate the die locator with respect to the cam base.

11. The assembly of claim 10, wherein the cam base defines a cam or a ramp configured to slide beneath each of the plurality of forming dies upon rotation of the die locator, the cam base configured to remain stationary.

12. The assembly of claim 10, wherein the mechanical rotator comprises a machine fork apparatus configured to couple with an underside of the assembly via insertion of one or more protrusions of the machine fork apparatus into one or more receiving apertures defined by the assembly.

13. The assembly of claim 10, wherein one of the plurality of the forming dies is selectively elevated to the operational height, adjacent the workpiece, while the remaining dies remain at a position away from the workpiece.

14. The assembly of claim 10, further comprising a plurality of die sleeves coupled with the plurality of forming dies, each of the plurality of die sleeves configured to restrict vertical displacement of one of the plurality of forming dies.

15. The assembly of claim 10, wherein the die locator comprises a body having a circular perimeter and defining a plurality of die bores, each die bore configured to receive one of the plurality of forming dies.

16. A multi-die carrier assembly, comprising:

a die locator configured to retain a plurality of forming dies; and a slidable puck coupled with the die locator and configured to select one of the plurality of forming dies for operation on a workpiece by retaining or elevating the selected forming die at an operational height;

wherein the die locator and the slidable puck define complementary mating surfaces that form a slidable interface configured to accommodate relative motion between the die locator and the slidable puck; and wherein the slidable puck defines a plurality of camming surfaces each configured to slide beneath and elevate one of the plurality of forming dies.

17. The assembly of claim 16, wherein the slidable puck further defines a plurality of contact surfaces opposite the plurality of camming surfaces, each contact surface configured to receive a lateral pushing force applied by a pin member.

18. The assembly of claim 16, wherein the slidable puck comprises a bistable member configured to cause lateral movement of the slidable puck beneath each of the plurality of forming dies in response to a pushing force.

19. The assembly of claim 18, wherein the bistable member comprises a spring-loaded push-pin configured to receive a manual and/or mechanical pushing force.

* * * * *